US010046245B1

(12) United States Patent
Whincup

(10) Patent No.: US 10,046,245 B1
(45) Date of Patent: Aug. 14, 2018

(54) OBSTACLE APPARATUS AND METHOD

(71) Applicant: Galaxy America Inc., Port Charlotte, FL (US)

(72) Inventor: Robin Whincup, Port Charlotte, FL (US)

(73) Assignee: Galaxy America Inc., Port Charlotte, FL (US)

( * ) Notice: Subject to any disclaimer, the term of this patent is extended or adjusted under 35 U.S.C. 154(b) by 0 days.

(21) Appl. No.: 15/598,875

(22) Filed: May 18, 2017

Related U.S. Application Data

(60) Provisional application No. 62/346,253, filed on Jun. 6, 2016.

(51) Int. Cl.

| | |
|---|---|
| ***A63G 21/00*** | (2006.01) |
| ***A63G 31/00*** | (2006.01) |
| ***A63G 31/02*** | (2006.01) |
| ***A63G 31/10*** | (2006.01) |

(52) U.S. Cl.
CPC ..... *A63G 31/02* (2013.01); *A63G 31/00* (2013.01); *A63G 31/10* (2013.01)

(58) Field of Classification Search
CPC ..... A63C 19/00; A63C 19/10; A63C 17/00; A63C 17/014; A63C 17/02; A63C 17/04; A63C 17/10; A63C 2201/02; A63C 2201/04; A63G 29/00; A63G 21/00; A63G 31/00; A63G 31/02; A63G 31/10
USPC ..... 472/88–92, 136; 482/34–36
See application file for complete search history.

(56) References Cited

U.S. PATENT DOCUMENTS

| | | | | |
|---|---|---|---|---|
| 1,746,127 | A | 2/1930 | Overholt | |
| 3,709,197 | A | 1/1973 | Moseley | |
| 3,826,353 | A | 7/1974 | Greasley | |
| 4,095,561 | A | 6/1978 | Ruetenik | |
| 4,260,318 | A | 4/1981 | Holritz et al. | |
| 4,423,864 | A * | 1/1984 | Wiik | A63B 22/0012 434/253 |
| 4,813,526 | A | 3/1989 | Belanger | |
| 5,387,159 | A * | 2/1995 | Hilgert | A63B 19/04 405/79 |
| 5,499,899 | A | 3/1996 | Hibbs | |
| 5,875,883 | A | 3/1999 | Ertel et al. | |
| 5,902,089 | A | 5/1999 | Sinn et al. | |
| 7,513,832 | B2 * | 4/2009 | Gallagher | A63C 19/10 14/69.5 |
| 7,951,011 | B2 | 5/2011 | Lochtefeld | |
| 8,784,224 | B1 | 7/2014 | Schafer | |

* cited by examiner

*Primary Examiner* — Kien Nguyen
(74) *Attorney, Agent, or Firm* — Frijouf, Rust & Pyle, P.A.

(57) ABSTRACT

An obstacle apparatus is disclosed for an individual to traverse. The obstacle apparatus comprises a chassis and a frame. A hinge pivotably couples the chassis and the frame for positioning the frame in an inclined orientation relative to the chassis. A first drum is rotatably coupled to the frame. A second drum is rotatably coupled to the frame. A belt encircles the first drum and the second drum for defining a continuous loop belt system. A drive engages the continuous loop belt system for creating a displacement in the belt. The belt defines an upper belt surface for the individual to traverse.

39 Claims, 26 Drawing Sheets

OBSTACLE APPARATUS AND METHOD

CROSS-REFERENCE TO RELATED APPLICATIONS

This application claims benefit of U.S. Patent Provisional Application No. 62/346,253 filed Jun. 6, 2016. All subject matter set forth in Provisional Application No. 62/346,253 is hereby incorporated by reference into the present application as if fully set forth herein.

BACKGROUND OF THE INVENTION

Field of the Invention

This invention relates to obstacles and more particularly to an obstacle apparatus for an individual to traverse.

Background of the Invention

Amusement rides have been a popular recreational activity for decades. The popularity of these amusements in fixed locations led to the development of carnivals and their mobile and portable amusement rides. The evolution of these amusement rides continued and many smaller, more portable rides were devised.

These smaller, lighter rides required easy, quick erection for use and disassembly for movement to the next venue. These devices are generally constructed to be folding and integral with the vehicle used for transport such as a trailer or the like. The constraints of the ability to develop more complex amusement rides yet be easily disassembled and reduced to legal on-road transportation limits presents significant problems for the amusement ride developer.

There have been many in the prior art who have attempted to solve these problems with varying degrees of success. None, however completely satisfies the requirements for a complete solution to the aforestated problem. The following U.S. Patents are attempts of the prior art to solve this problem.

U.S. Pat. No. 1,746,127 to Overholt discloses an unloading device of the class described, comprising a casing having its top and one end open, a roller journaled in each end of the casing, and intermediate rollers in the casing. Shafts on which the rollers are loosely mounted run with an endless belt passing over the rollers, shields at the sides of the casing have channel shaped lower edges for receiving the edges of the belt. Adjustable gates in the top of the casing control the flow of material onto the belt.

U.S. Pat. No. 3,709,197 to Moseley discloses an exercising apparatus for horses, comprising: a mobile body having upwardly extending sidewalls. The sidewalls define a stall and a moveable exercising surface on the floor of the stall. A means is provided to incline the exercising surface with respect to the horizontal for causing the horse within the stall to walk. A means is operably connected to the exercising surface for initiating movement of the exercising surface when inclined and when a horse is standing thereon. Thereby stimulating the walking of the horse. An adjustable drag-brake means is operably connected to the exercising surface for controlling the movement of the exercising surface whereby a horse is caused to walk at a predetermined uniform rate.

U.S. Pat. No. 3,826,353 to Greasley discloses a conveyor including a first elongated support which is movably coupled to a support structure, and a second elongated support which is supported by the first support. A conveyor belt, engaged with the first support, the second support, and a motor, tends to extend or retract the second support with respect to the first support depending on the sense of rotation imparted to the belt by the motor. However, a brake means connected between the first and second supports continuously creates a frictional force which prevents relative motion between the first and second supports due to the action of the free running belt. The second support includes means for directly trapping the moving belt, thereby causing the belt to apply a force between the first and second supports which overcomes the frictional force provided by the brake means and creates relative motion between the first and second supports.

U.S. Pat. No. 4,095,561 to Ruetenik discloses an improved animal exercising apparatus including a releasable towing package, improved safety features, a manure scraper and container, removable side panel inserts, breast and butt restraining straps, and a variable speed motor. The improved features include angled side wall corners to prevent damage to the animal's head and neck and teeth during exercising. The releasable towing package provides separately releasable wheels and a tow bar for selective transportation of one or a plurality of exercising apparatuses. A loading guide is also provided to improve the loading of the animal. One improved embodiment is designed for use by horses whereas a second improved embodiment has angularly oriented outward extending side walls and is designed for use by livestock such as cattle and sheep. In the second embodiment an upstanding tie bar is further provided to properly exercise livestock by holding their head in the proper lead position.

U.S. Pat. No. 4,260,318 to Holritz, et al. discloses an apparatus for installing pre-assembled escalators having upper and lower ends in an operating position between upper and lower landings. A wheeled support apparatus is provided for supporting and transporting an escalator. A scissors lift apparatus is mounted on the wheeled support apparatus, and a pivotal escalator truss support and locator assembly is mounted on the scissors lip apparatus. They cooperate to provide both vertical and angular adjustment of the escalator, in order to permit the upper end to be aligned with and then supported by a support wall associated with the upper landing, and to permit its lower end to be subsequently lowered into a pit associated with the floor of the lower landing.

U.S. Pat. No. 4,813,526 to Belanger discloses a mobile conveyor unit having first and second conveyors mounted on a drivable, wheeled chassis in back-to-back relation. At least one of the conveyors in the unit can be raised or lowered, extended or retracted, and swung laterally to increase the range of the conveyor. An operating station is provided on the chassis to control the operation of the chassis and the two conveyors. A second operating station is provided at the outer end of the one conveyor to also control the operation of the one conveyor.

U.S. Pat. No. 5,499,899 to Hibbs discloses a conveyor rotatably mounted to a vehicle. The conveyor includes a plurality of frame members pivotally coupled to one another, such that they can be placed in overlapping relationship for transport with the vehicle or unfolded for use. An extension member is slidably coupled to one of the frame members such that the conveyor can be extended beneath a rail car for receiving material therefrom.

U.S. Pat. No. 5,875,883 to Ertel, et al. discloses a conveyor comprising a first conveyor section and a second conveyor section which can be pivoted from a first position where it is in alignment with the first conveyor section to a second position where it is at an inclined angle with respect to the first conveyor section. A shaft pivotally connects the adjacent ends of the two conveyor sections together, and a spindle or pulley is journaled on the shaft and supports an endless belt in travel in a conveying run and a return run on the conveyor sections. A slide is mounted for sliding movement on each side rail of the first conveyor section and each slide carries a hold down roller which rides against the side edge of the upper working surface of the belt and hold the belt tangent to both the first and second conveyor sections. Each slide is also provided with a rack which is engaged with a gear that is fixed to the second conveyor section and is positioned concentrically of the pivot shaft. As the second conveyor section is pivoted relative to the first conveyor section, rotation of the gear moves the rack and slide plate move linearly to thereby change the position of the hold down roller relative to the spindle, thus maintaining the belt in a relatively taut condition.

U.S. Pat. No. 5,902,089 to Sinn, et al. discloses a poultry loading apparatus for transporting poultry from a confinement area such as a poultry house to a transport vehicle to allow transport of poultry from farm-to-farm or from farm-to-processing plant. The mobile poultry loading apparatus includes a conveyor system whereby poultry ride from a confinement area to the transport vehicle during loading. The conveying system includes a telescoping end that extends into and retracts from a coop during the loading process. A system of hydraulics controls the speed of the conveyor, aids in the transverse leveling of the machine, adjusts both the angle and tier of loading, and levels and controls the telescoping end of the conveyor.

U.S. Pat. No. 7,951,011 to Lochtefeld discloses a portable water ride having a trailer with a water catch basin built therein, wherein at least two pivoting supports are provided which can be deployed to an expanded position and stowed to a vertical position. When the supports are deployed, a flexible ride surface can be stretched between said supports to form an inclined ride surface upon which a sheet flow of water from a nozzle housing can be provided upon which water skimming maneuvers can be performed. A walkway on either side of the ride surface, as well as an entrance platform at the top of the ride surface, and other grated platforms, railings, etc., can also be provided.

U.S. Pat. No. 8,784,224 to Schafer discloses a modular water slide apparatus integrated with a transportable unit including a major slide structure, a minor slide structure, a plurality of water jet nozzles, a trailer, a water supply and storage tank, a water catch basin, a plurality of anchor columns, and at least one circular, spiral, or winding staircase.

Although the aforementioned prior art have contributed to the development of the art of amusement rides none of these prior art patents have solved the needs of this art.

Therefore, it is an object of the present invention to provide an improved mobile amusement ride.

Another object of this invention is to provide an improved mobile amusement ride which provides ease of disassembly, transportation, and erection.

Another object of this invention is to provide an improved mobile amusement ride that is easy to cost effectively produce.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to a mobile obstacle apparatus for an individual to traverse. The mobile obstacle apparatus is supported by a surface. The mobile obstacle apparatus comprises a chassis extending between a proximal end, a distal end, a first side, a second side, an upper side and a lower side. A plurality of wheels are rotatably coupled to the chassis for transporting the chassis over the surface. A frame extends between a proximal end, a distal end, a first side, a second side, an upper side and a lower side. A hinge pivotably couples the chassis and the frame for positioning the frame in an inclined orientation relative to the chassis. A first drum is rotatably coupled to the frame. A second drum is rotatably coupled to the frame. A belt encircles the first drum and the second drum for defining a continuous loop belt system. A drive engages the continuous loop belt system for creating a displacement in the belt. The belt defines an upper belt surface for the individual to traverse.

In one embodiment of the invention the slide includes a tubular member defining an interior rigid sliding surface extending between a proximal end and a distal end.

In another embodiment of the invention the slide includes an inflatable bladder defining an exterior semi-rigid sliding surface extending between a proximal end and a distal end.

The invention is also incorporated into the method of providing an obstacle for an individual to traverse. The method comprises the steps of rotating a belt encircling a first drum and a second drum coupled to a frame in a descending direction for the individual to traverse between a first elevation to a second elevation. The individual is supported upon a platform after traversing the belt in the second elevation. The individual descends upon a slide for positioning the individual from the second elevation to the first elevation.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
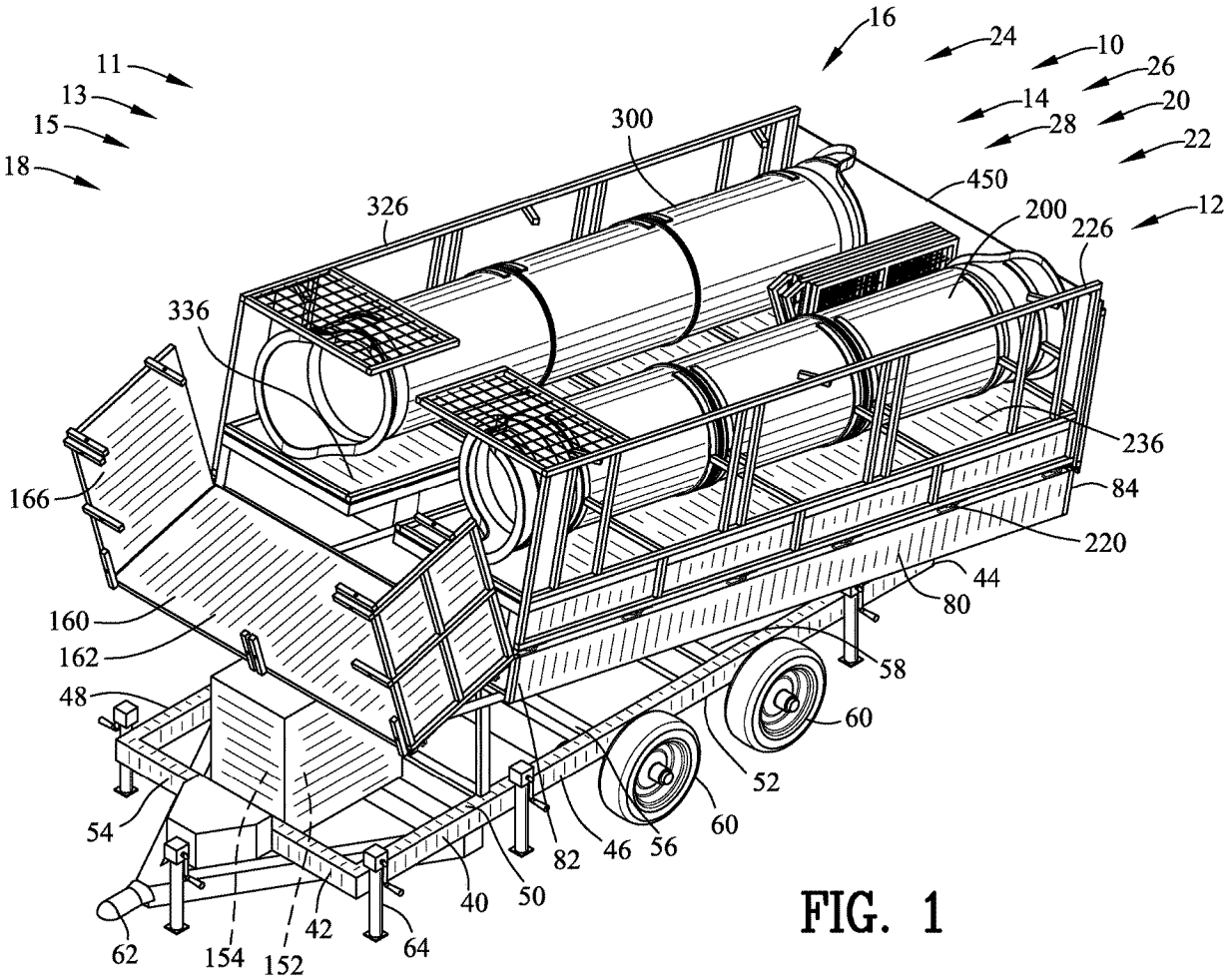
FIG. 1 is an upper front isometric view of a first embodiment of a mobile obstacle apparatus of the present invention.
Figure 2:
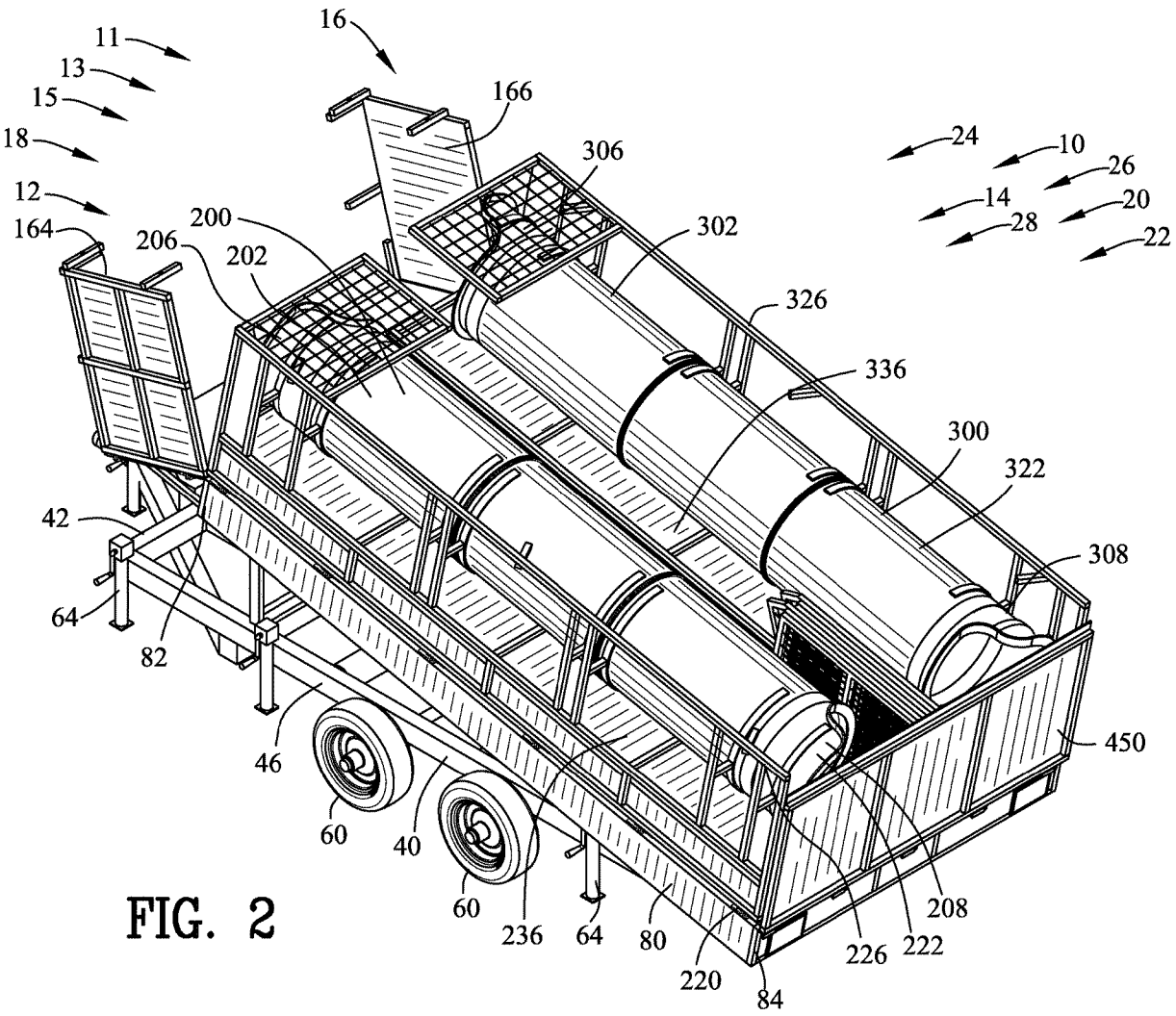
FIG. 2 is an upper rear view of FIG. 1.
Figure 3:
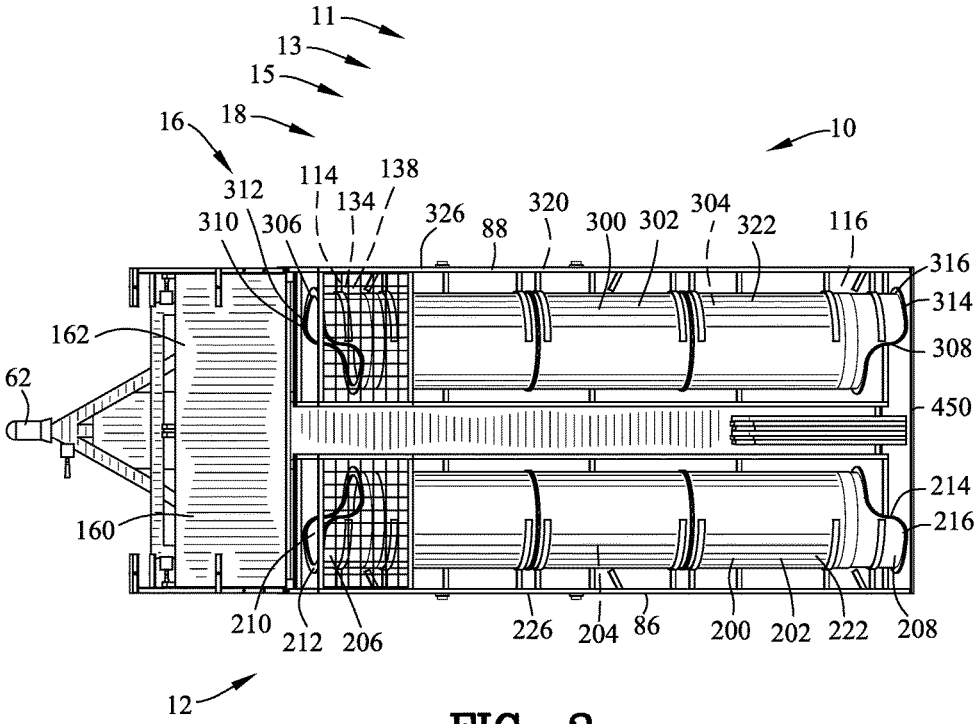
FIG. 3 is a top view of FIG. 1.
Figure 4:
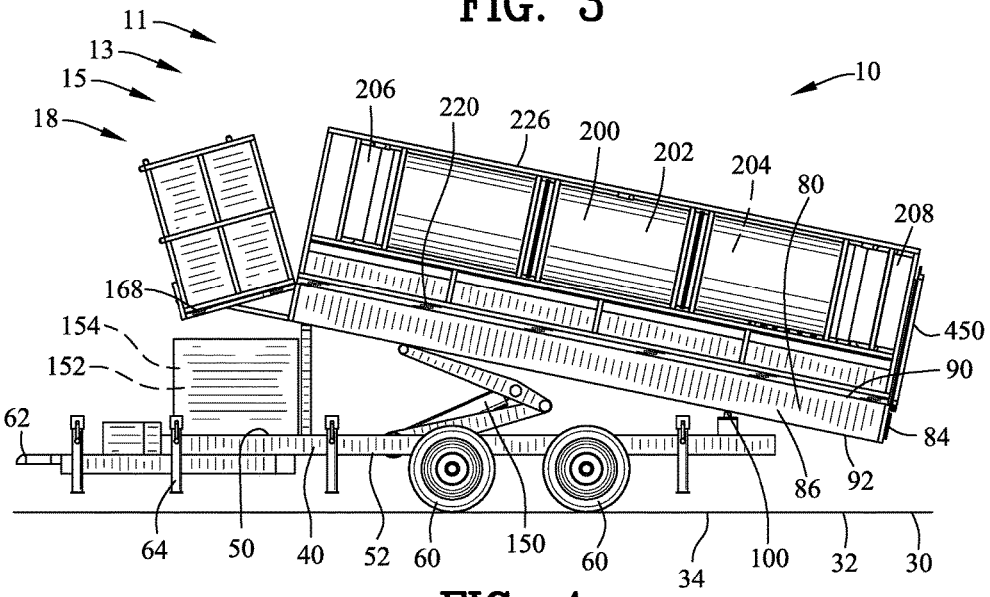
FIG. 4 is a right side view of FIG. 1.
Figure 5:
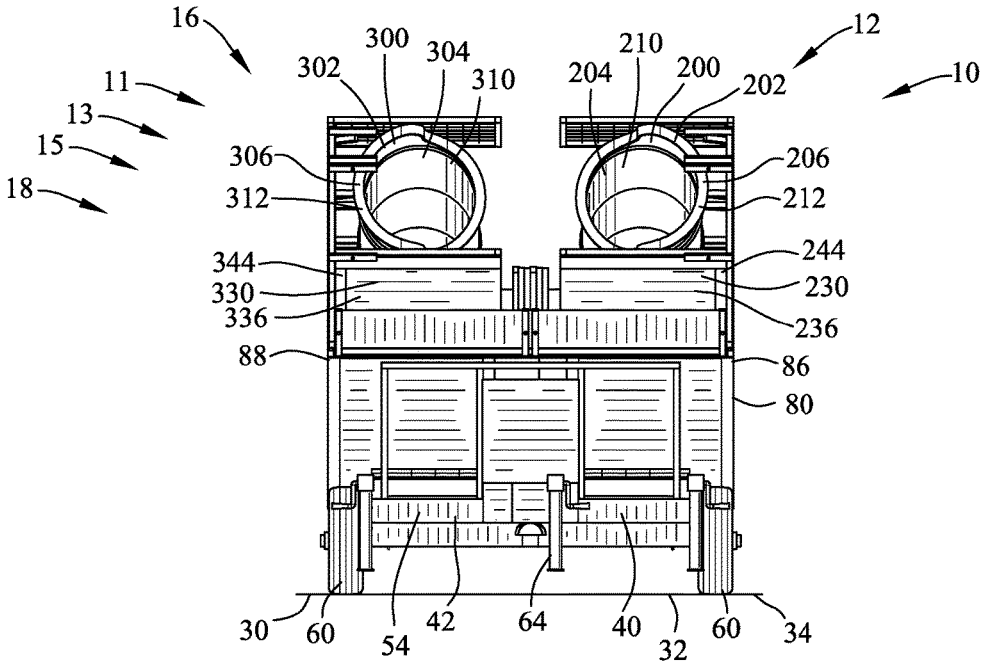
FIG. 5 is a front view of FIG. 1.
Figure 6:
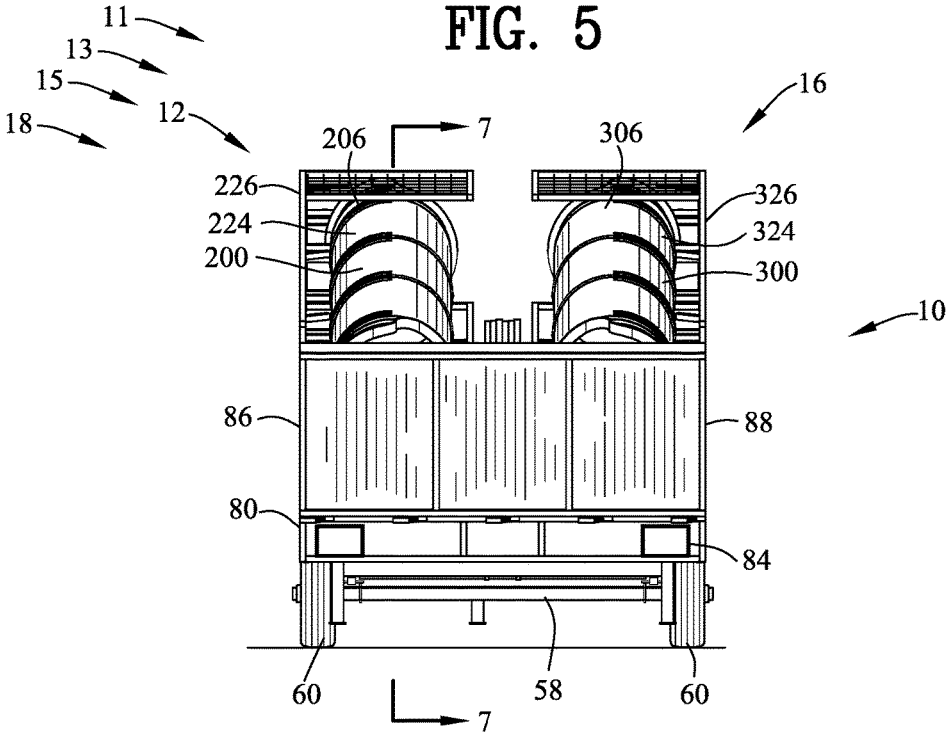
FIG. 6 is a rear view of FIG. 1.
Figure 7:
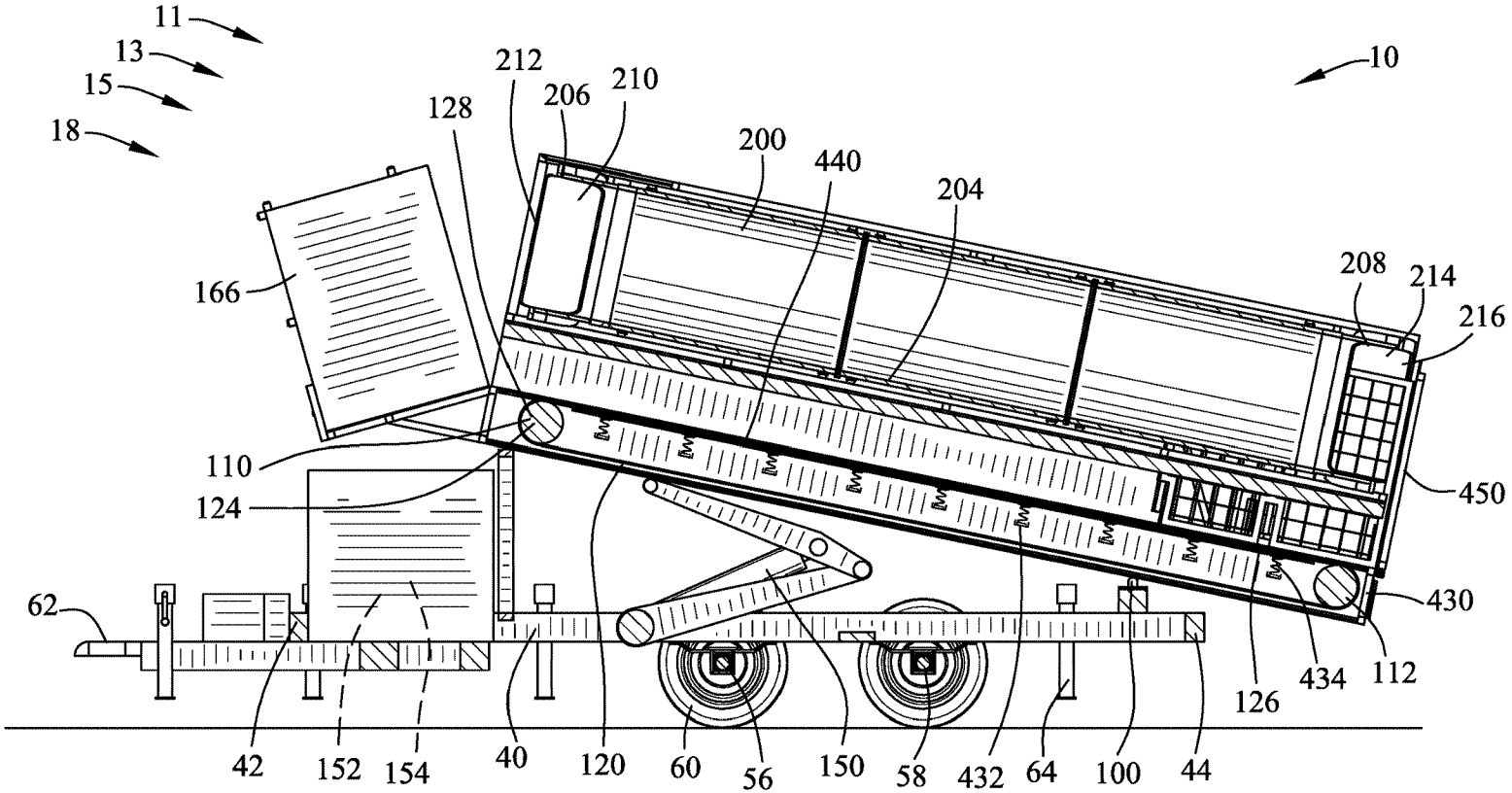
FIG. 7 is a sectional view along line 7-7 in FIG. 6.
Figure 8:
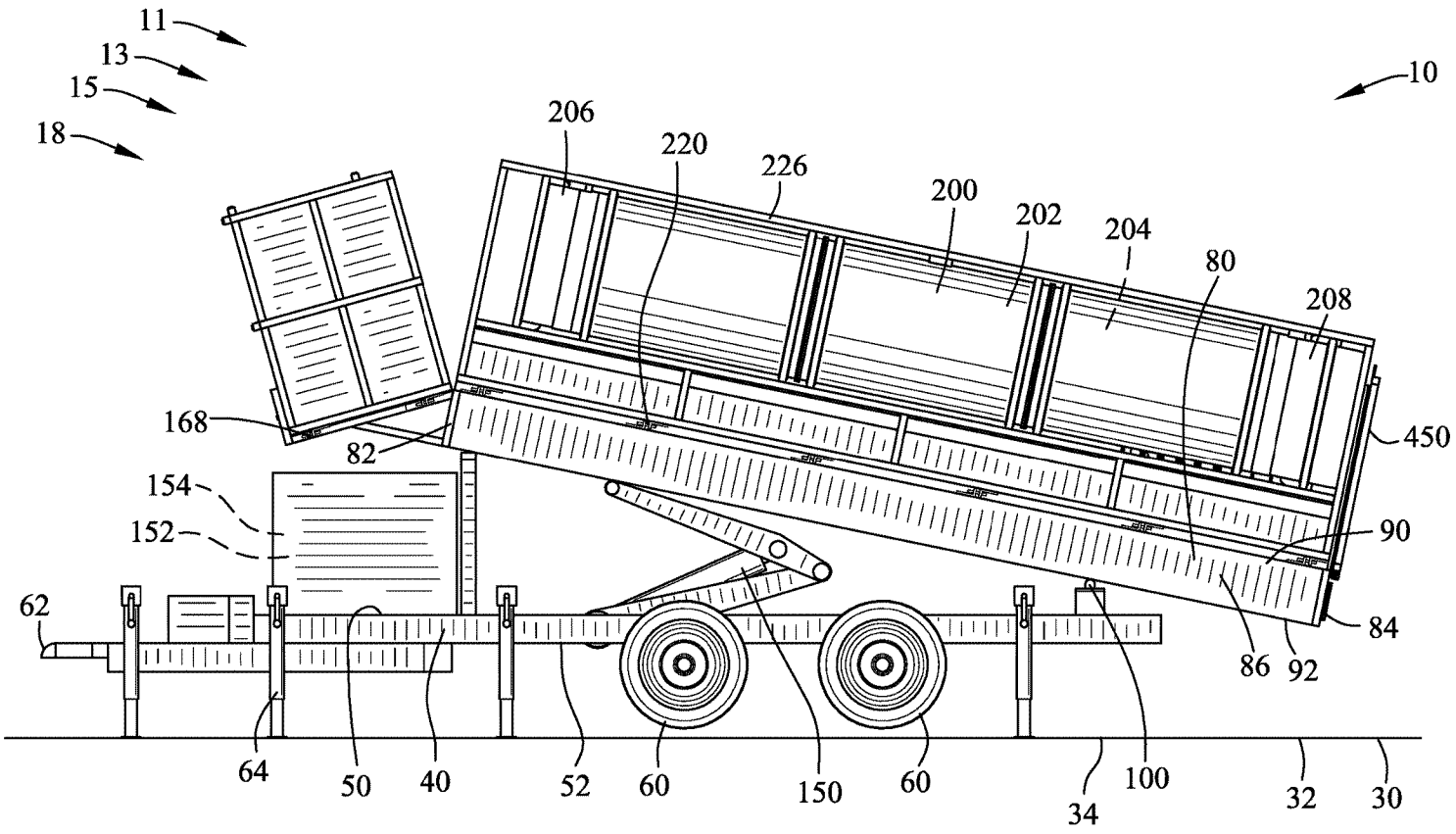
FIG. 8 is a view similar to FIG. 4 illustrating a plurality of lower telescoping jacks engaging a surface for stabilizing a chassis.
Figure 9:
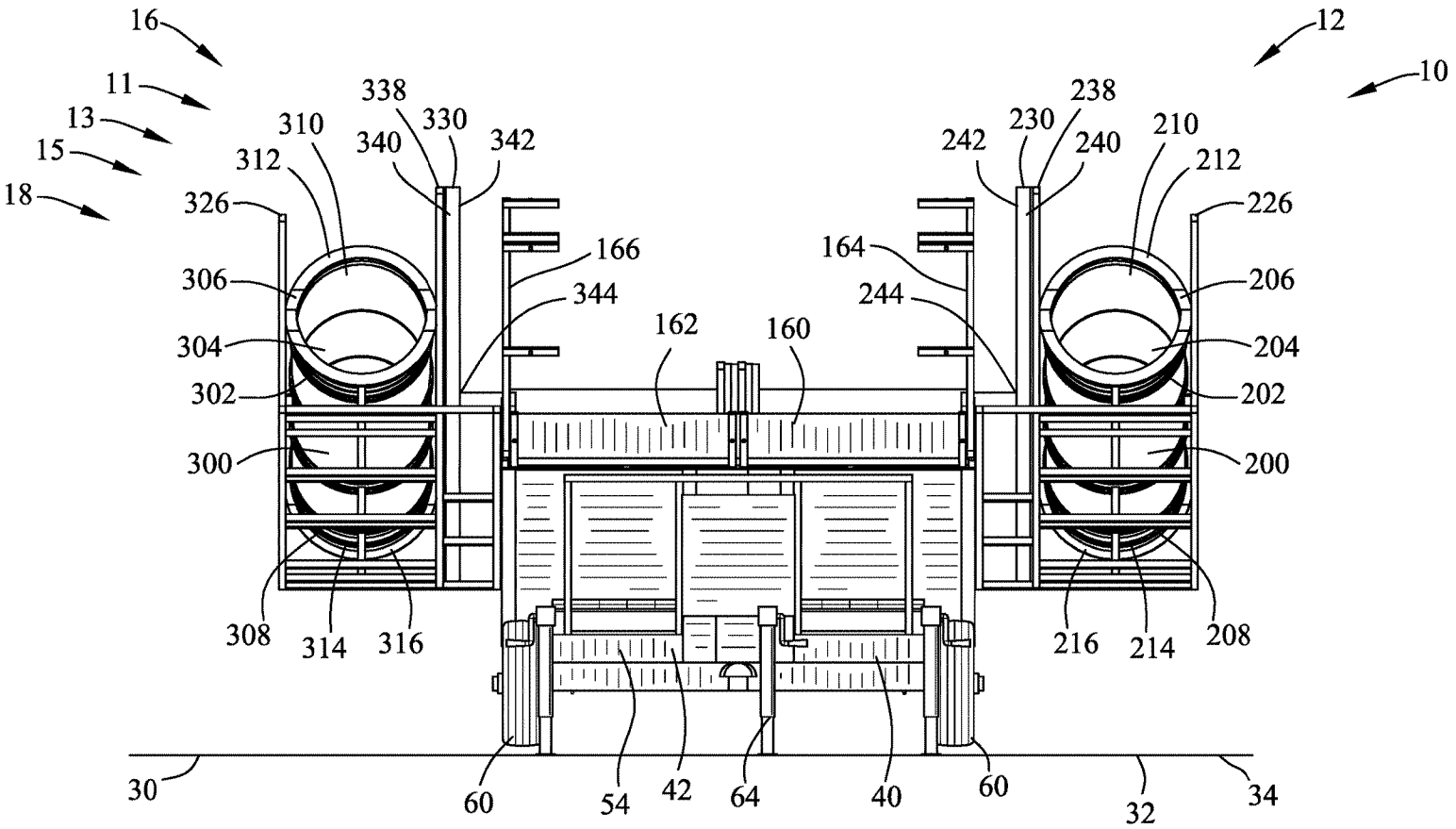
FIG. 9 is a view similar to FIG. 5 illustrating a first tubular member and a second tubular member being pivoted from an interior position above the frame to an exterior position adjacent to the frame.
Figure 10:
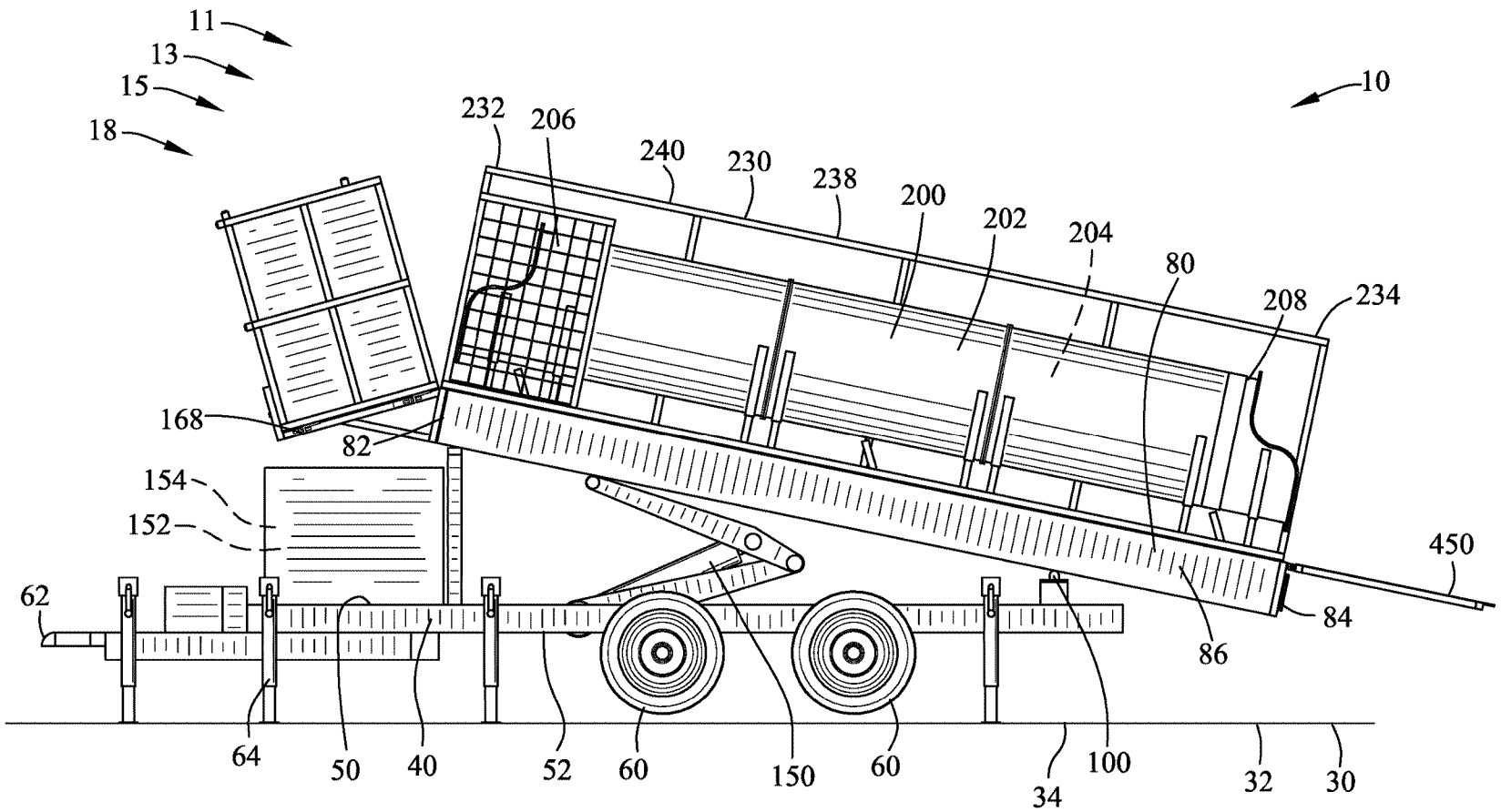
FIG. 10 is a view similar to FIG. 8 illustrating a tailgate being pivoted for engaging the surface.
Figure 11:
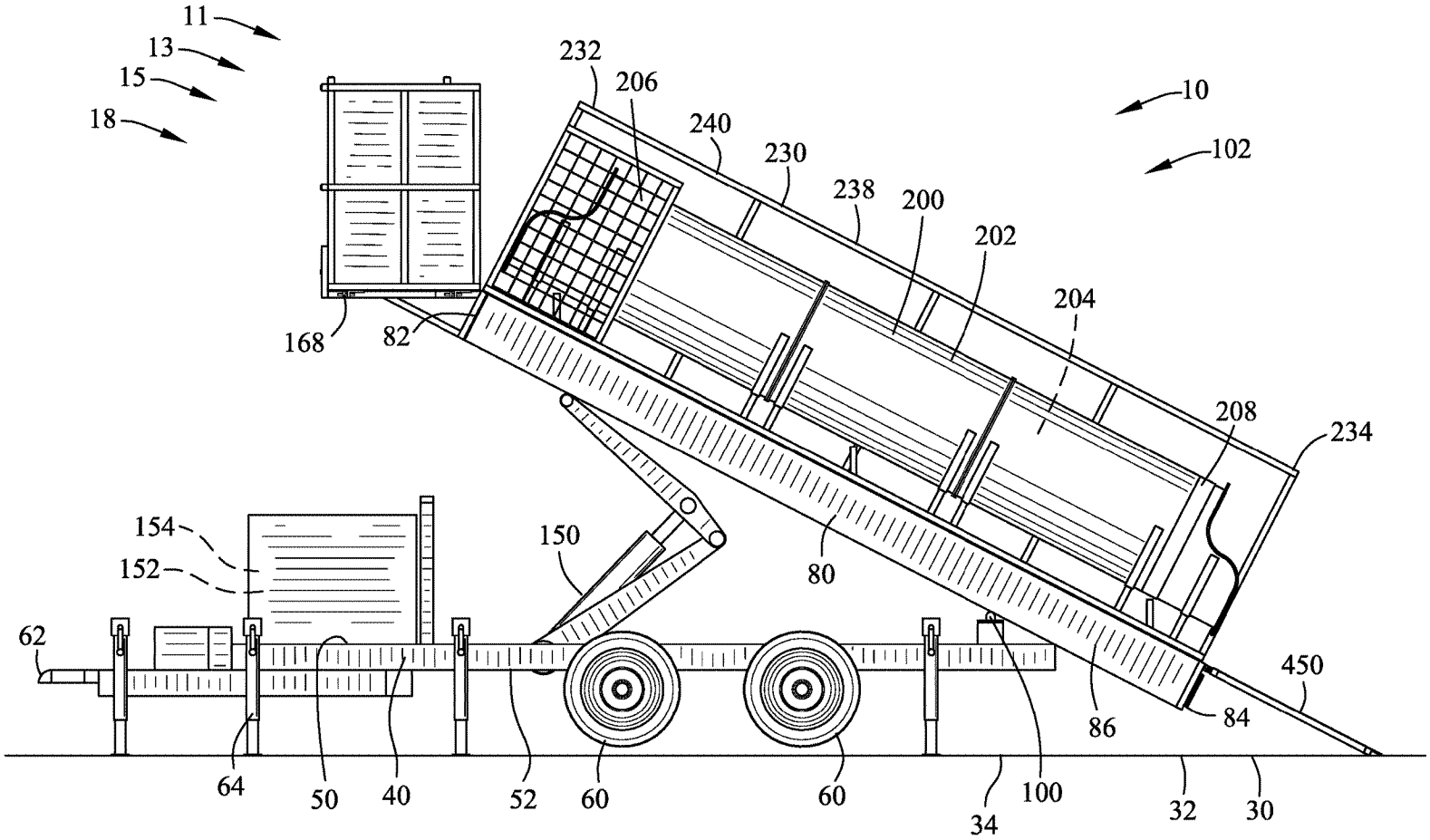
FIG. 11 is a view similar to FIG. 10 illustrating the frame being pivoted relative to the chassis for positioning a first belt and a second belt in an inclined orientation.
Figure 12:
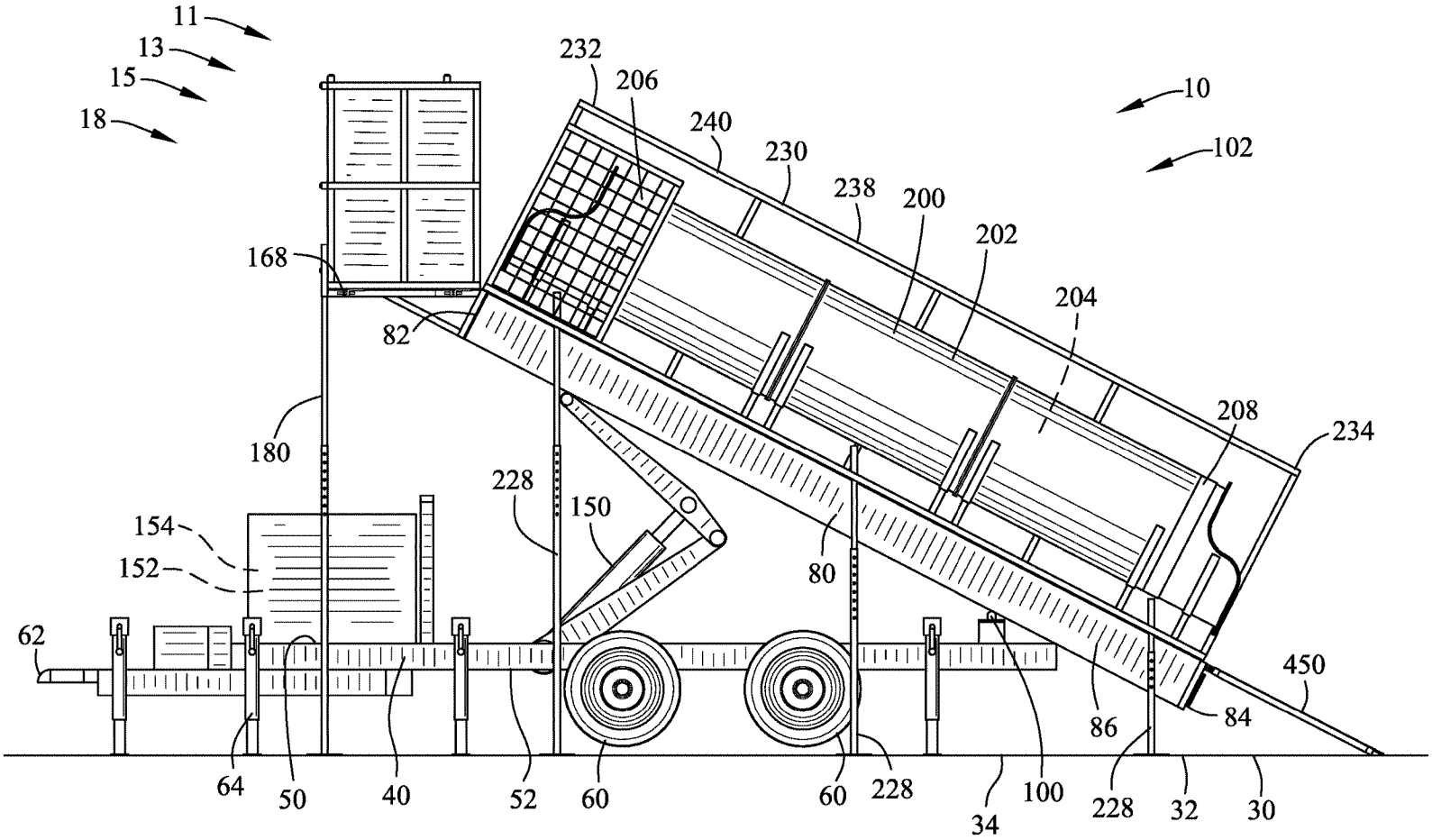
FIG. 12 is a view similar to FIG. 11 illustrating a plurality of slide telescoping jacks engaging a surface for stabilizing the first tubular member and the second tubular member and a plurality of platform telescoping jacks engaging a surface for stabilizing a main platform.
Figure 13:
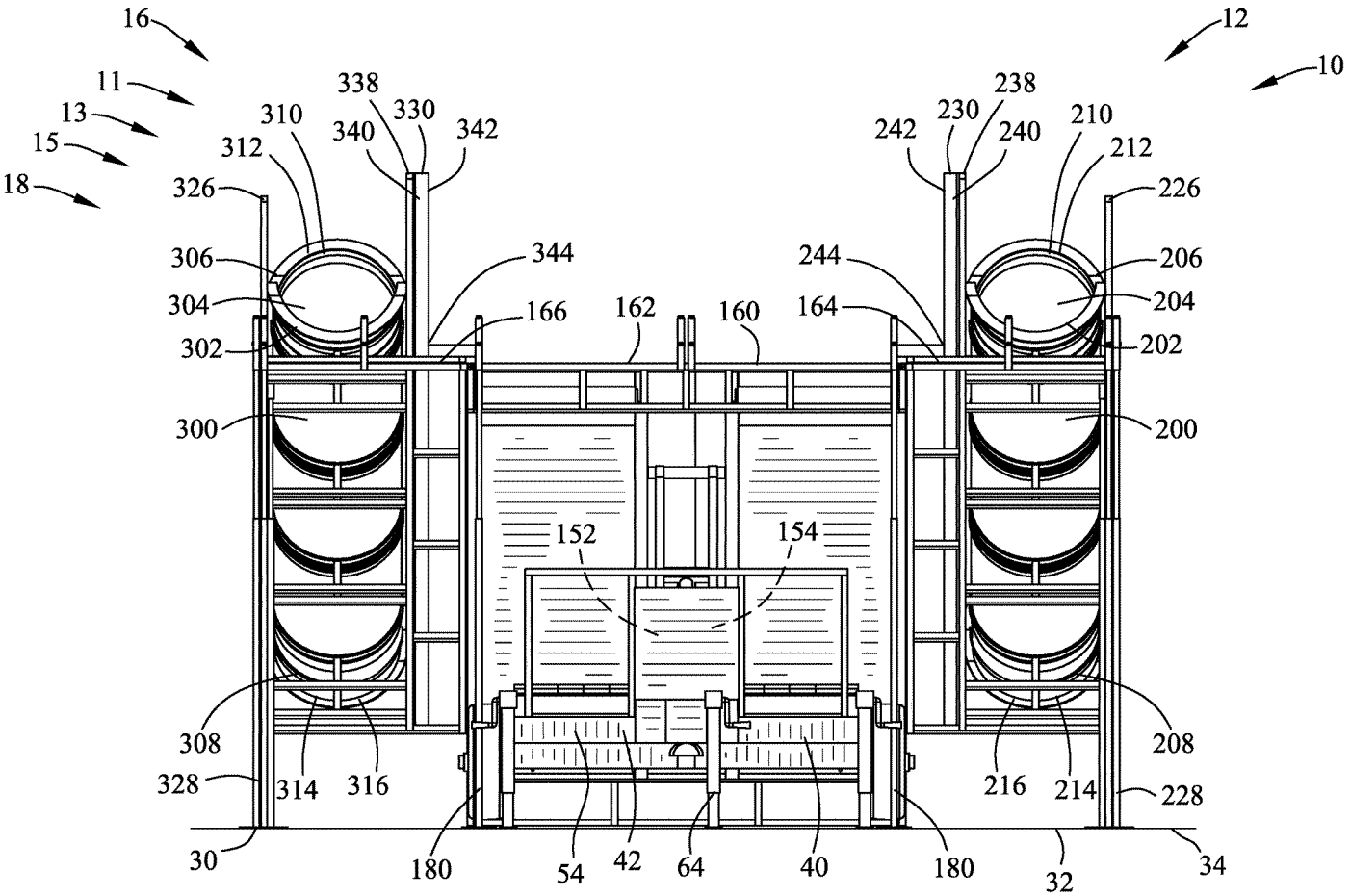
FIG. 13 is a view similar to FIG. 9 illustrating a primary platform and a secondary primary platform being positioned from a vertical orientation to a horizontal orientation relative to the main platform.
Figure 14:
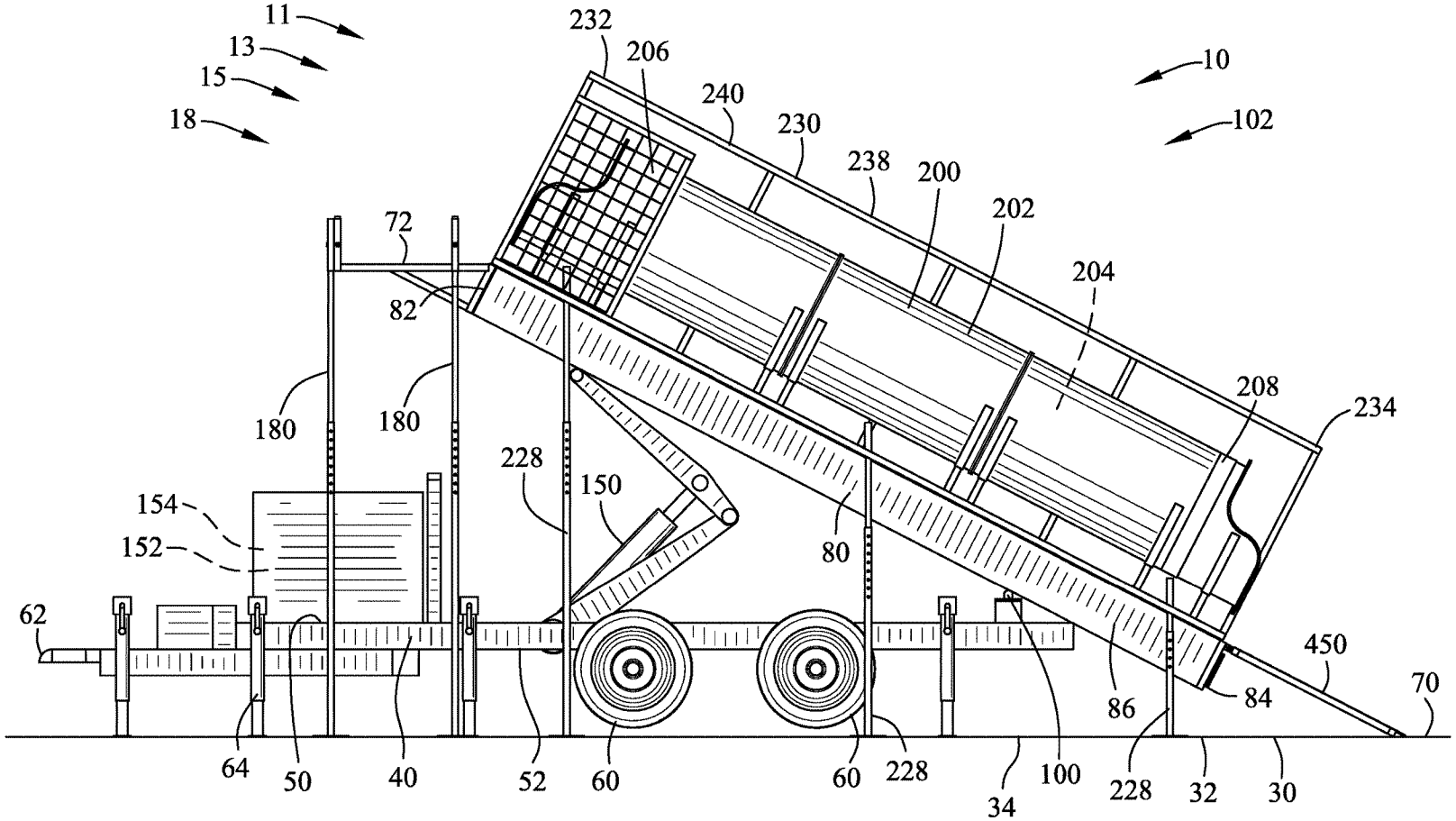
FIG. 14 is a view similar to FIG. 12 illustrating a third upper plurality of telescoping jacks engaging a surface for stabilizing the primary platform and the secondary primary platform.
Figure 15:
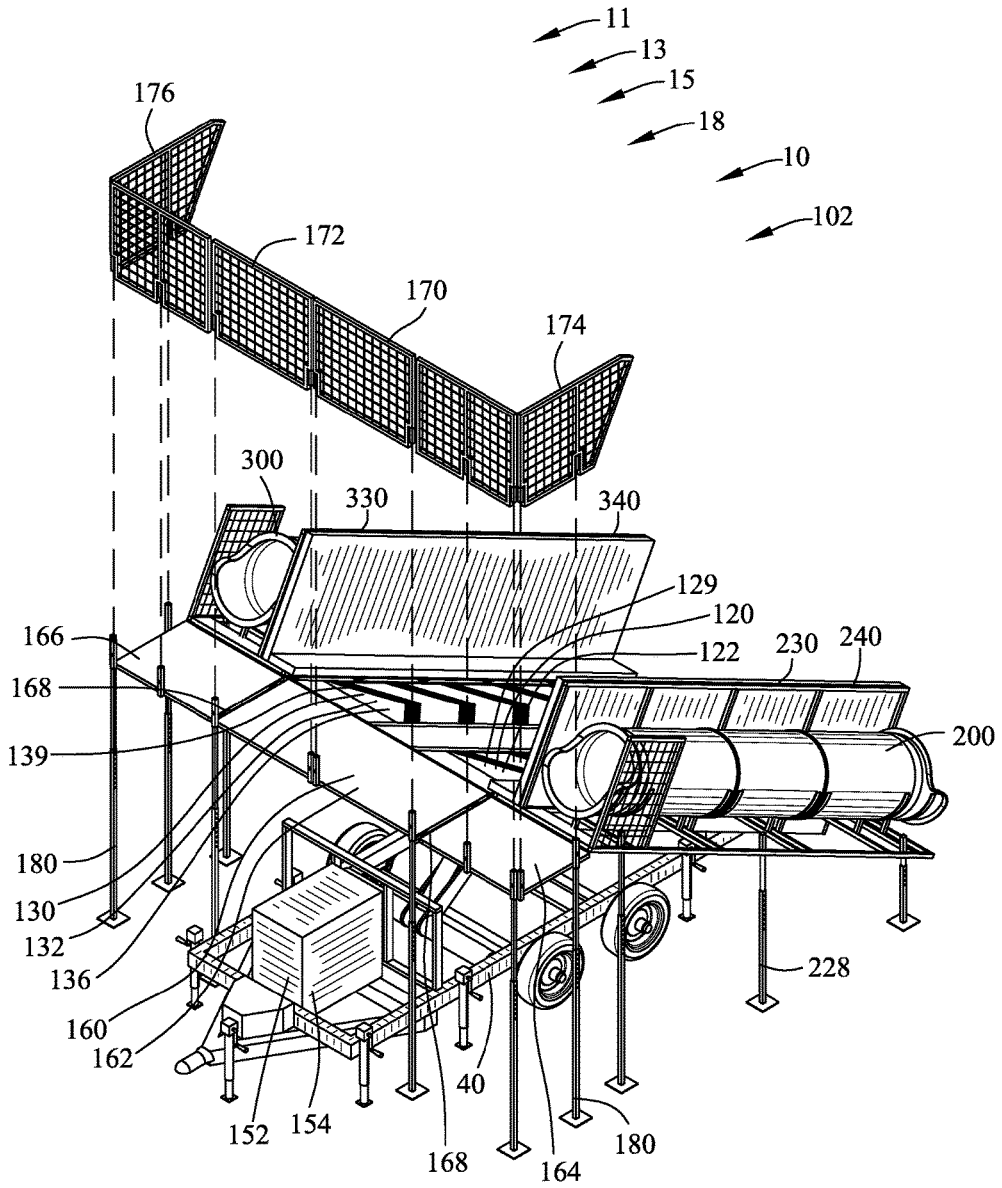
FIG. 15 is a view similar to FIG. 1 illustrating the alignment of a main platform railing with the main platform, a primary platform railing with the primary platform and a secondary platform railing with the secondary platform.
Figure 16:
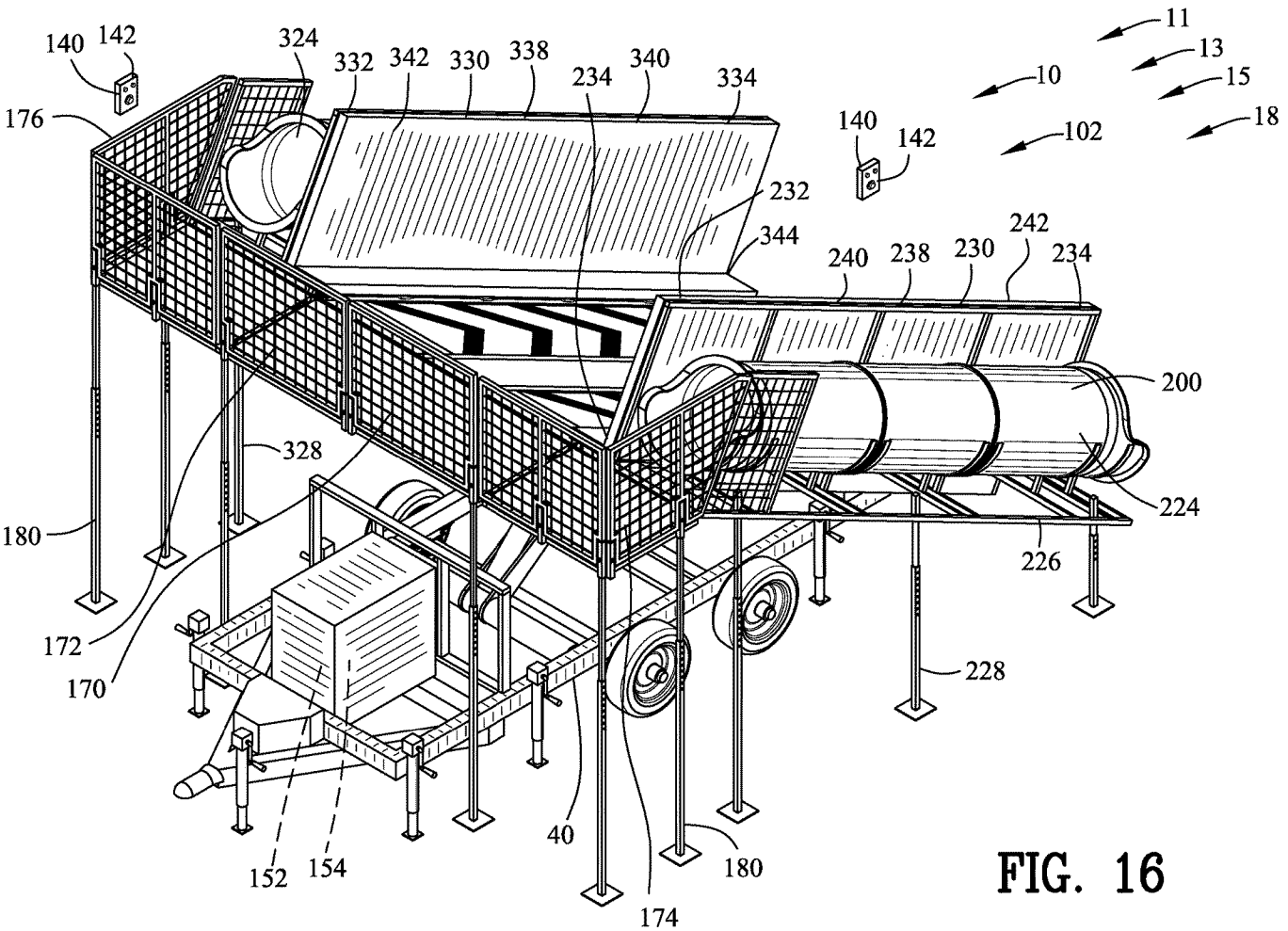
FIG. 16 is a view similar to FIG. 15 illustrating the engagement of a main platform railing with the main platform, a primary platform railing with the primary platform and a secondary platform railing with the secondary platform.
Figure 17:
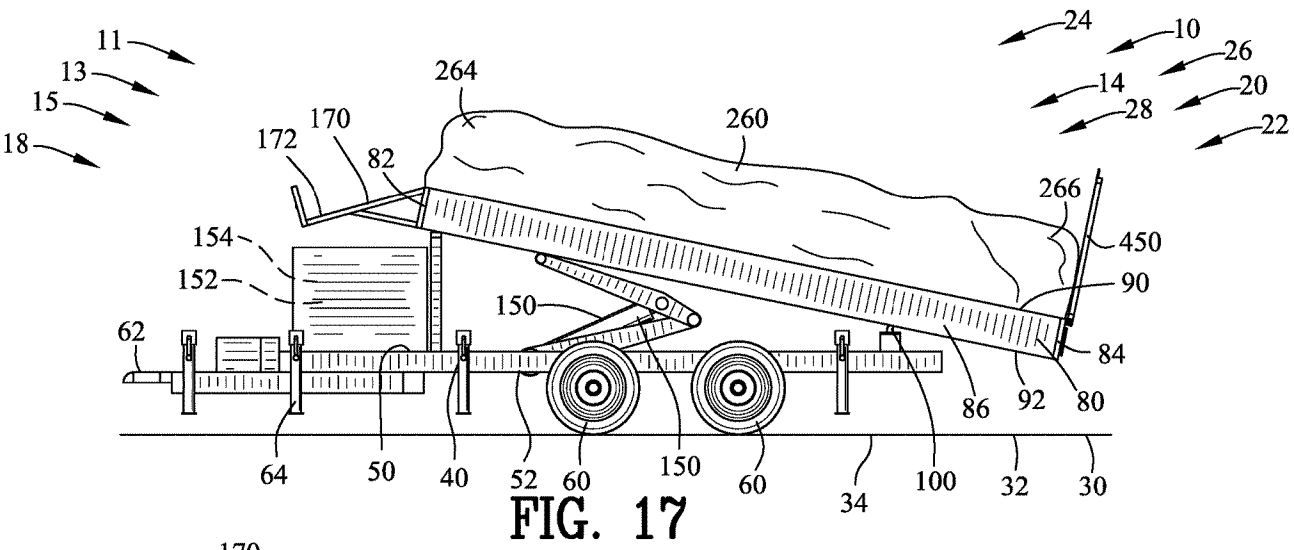
FIG. 17 is a right side view of a second embodiment of the mobile obstacle apparatus of the present invention.
Figure 18:
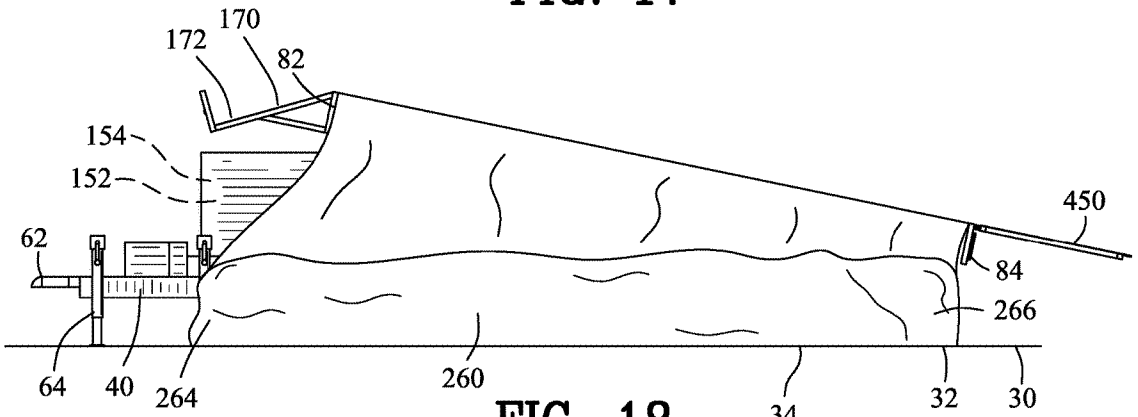
FIG. 18 is a view similar to FIG. 17 illustrating an inflatable bladder being positioned from an interior position above the frame to an exterior position adjacent to the frame.
Figure 19:
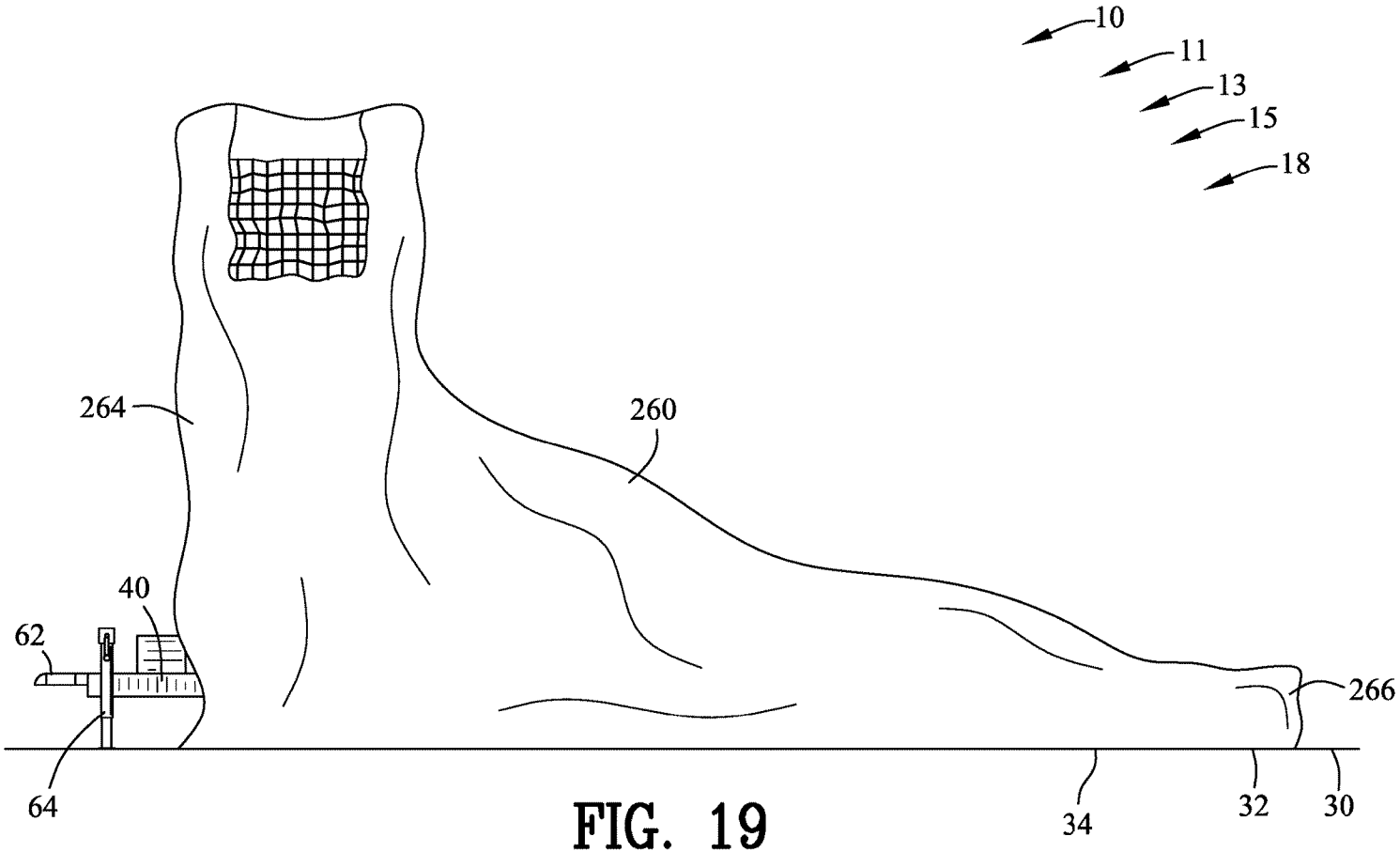
FIG. 19 is a view similar to FIG. 18 illustrating the inflatable bladder being inflated.
Figure 20:
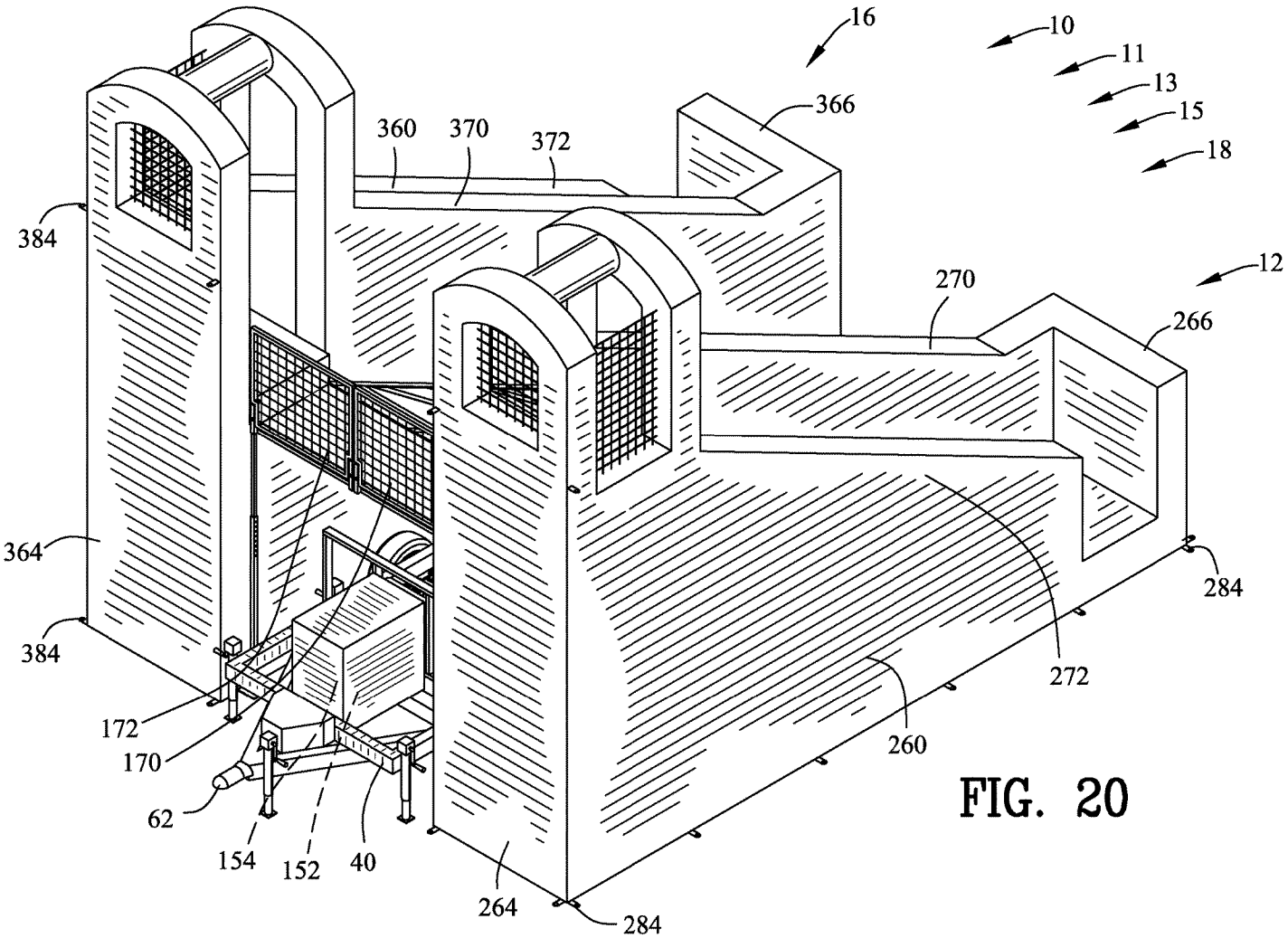
FIG. 20 is an upper front isometric view of FIG. 16 illustrating a first inflatable bladder and a second inflatable bladder adjacent to the frame.
Figure 21:
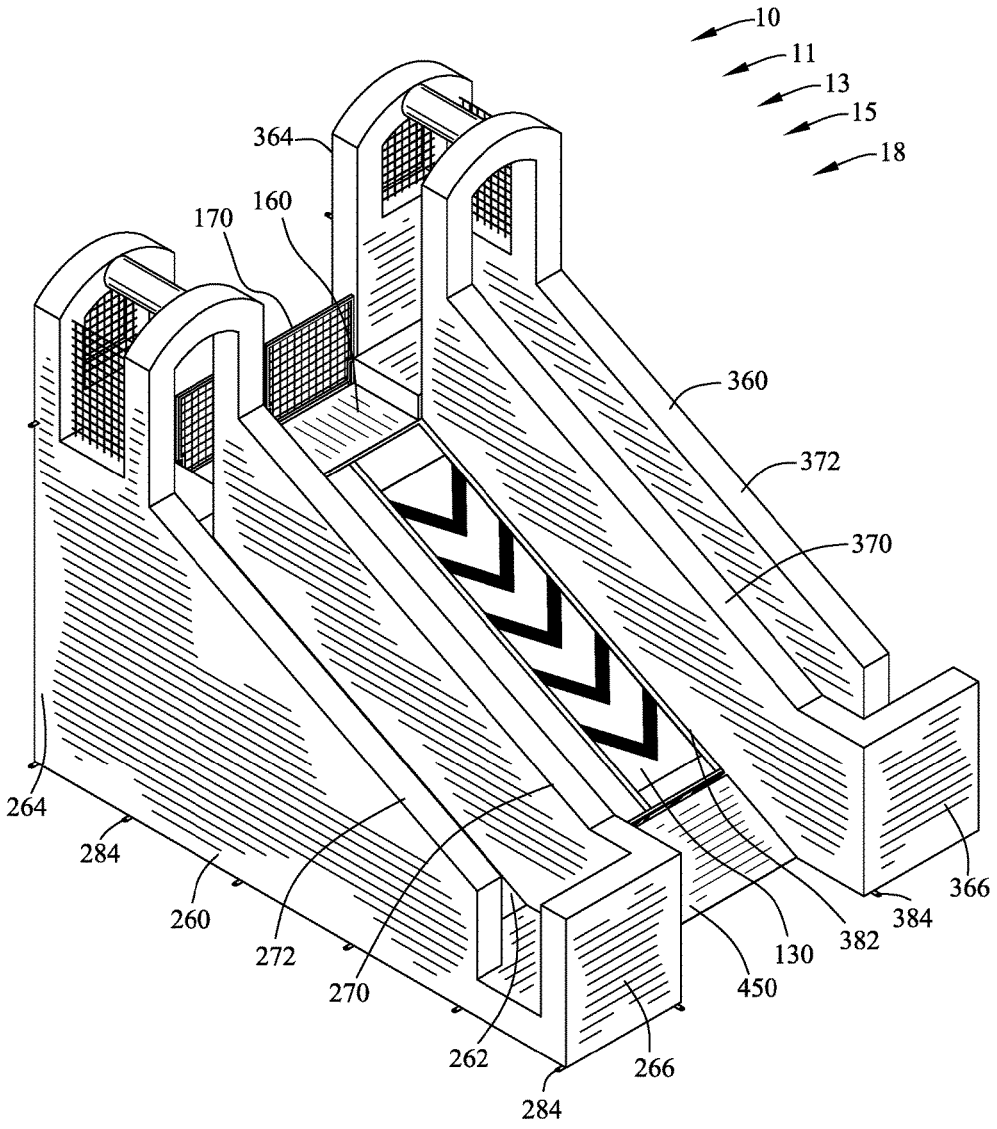
FIG. 21 is an upper rear isometric view of FIG. 20.
Figure 22:
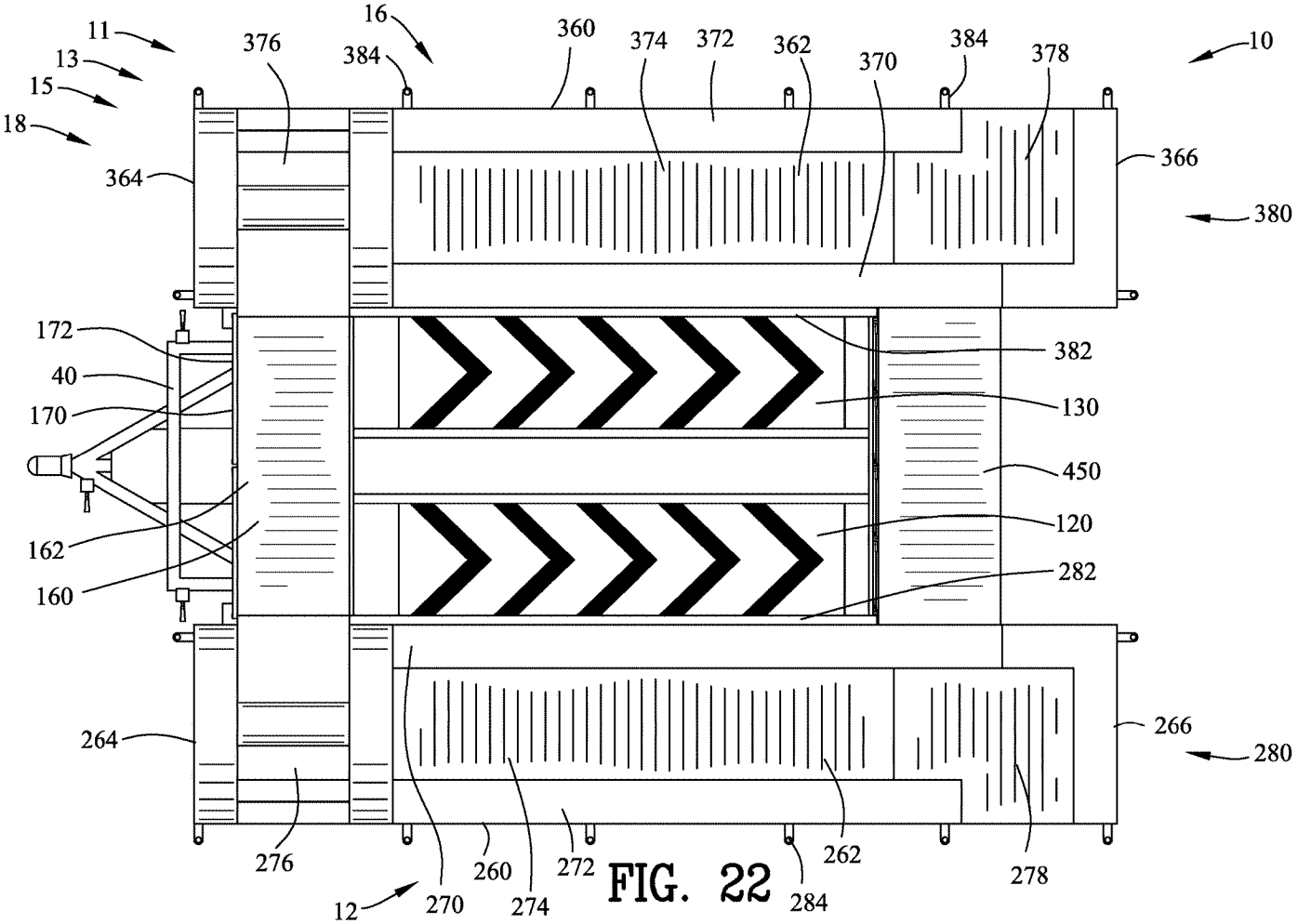
FIG. 22 is a top view of FIG. 20.
Figure 23:
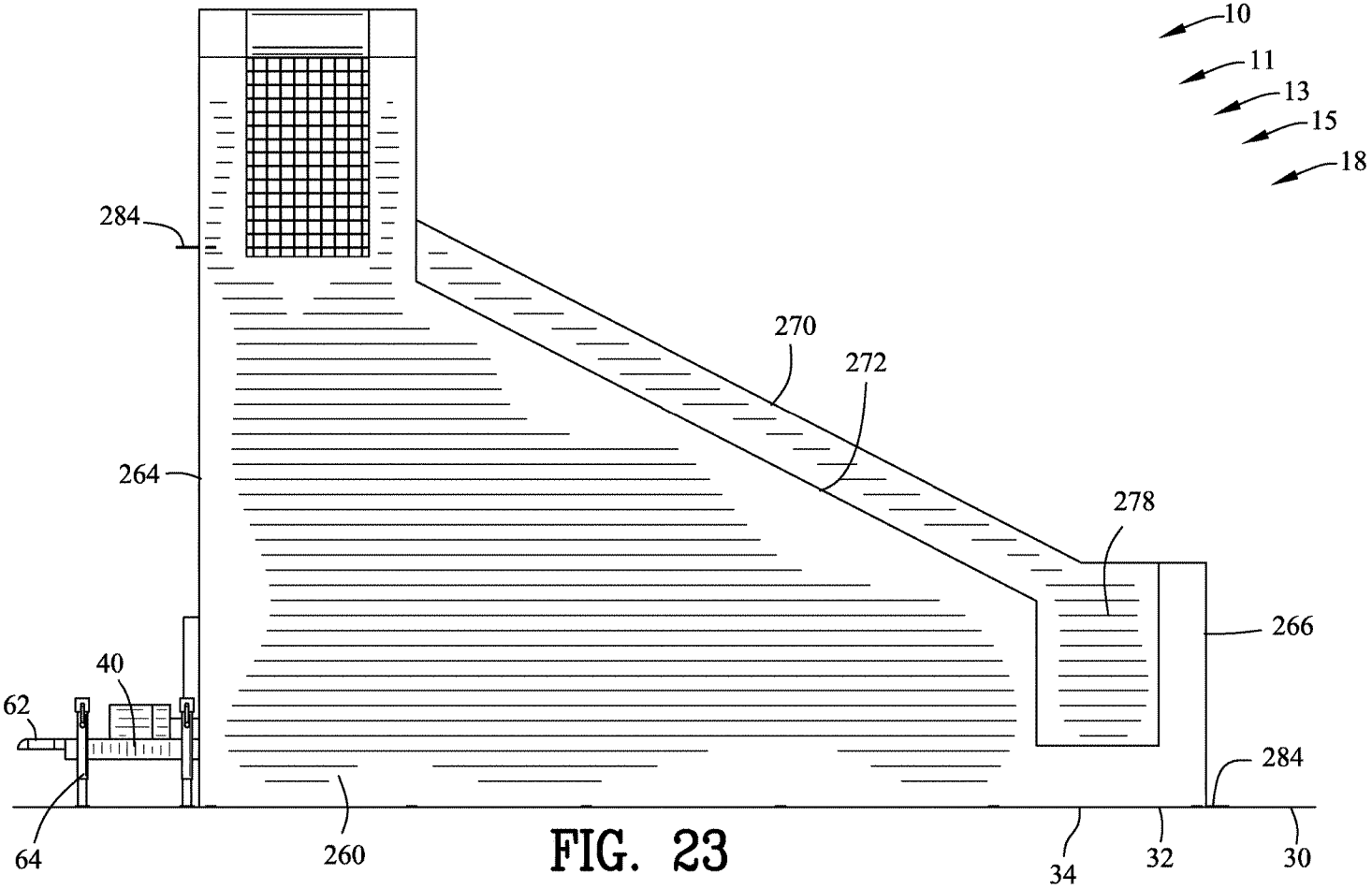
FIG. 23 is a right side view of FIG. 20.
Figure 24:
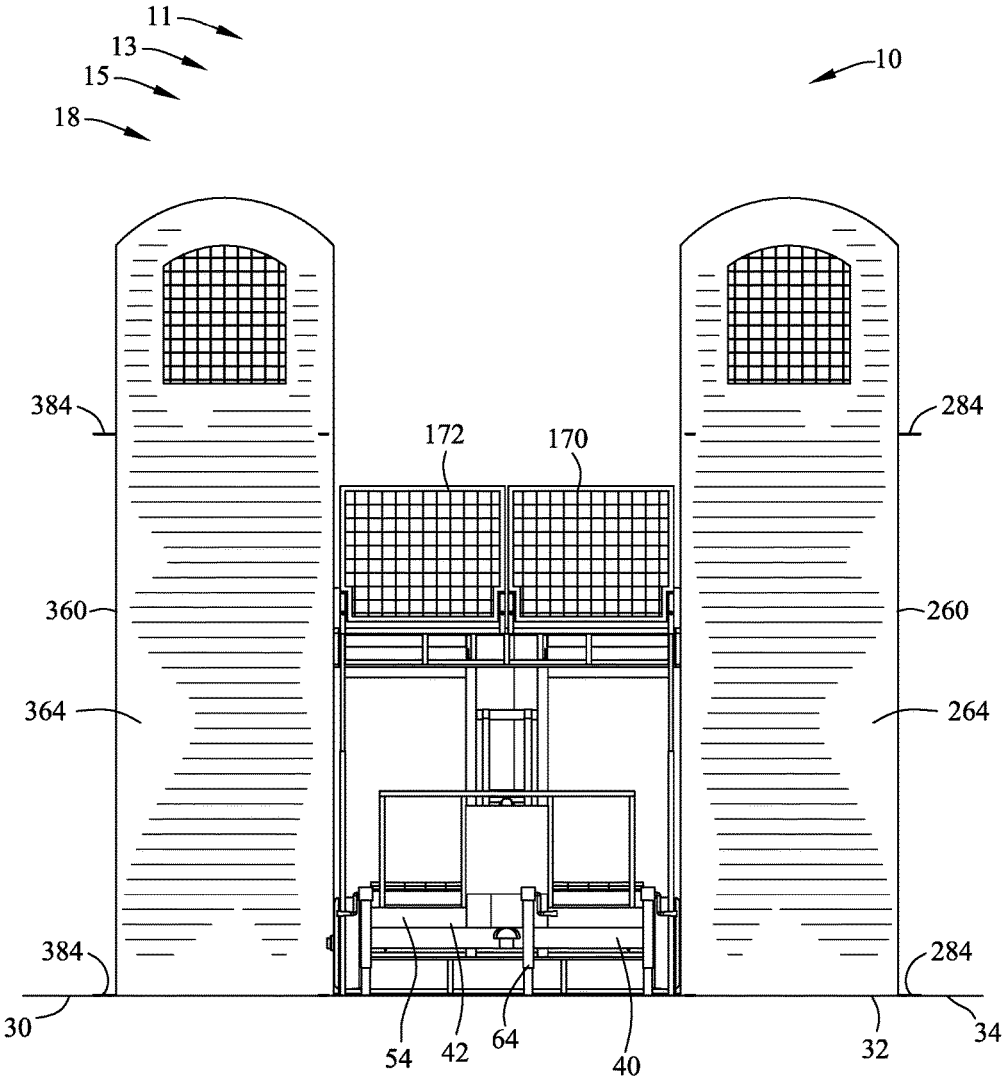
FIG. 24 is a front view of FIG. 20.
Figure 25:
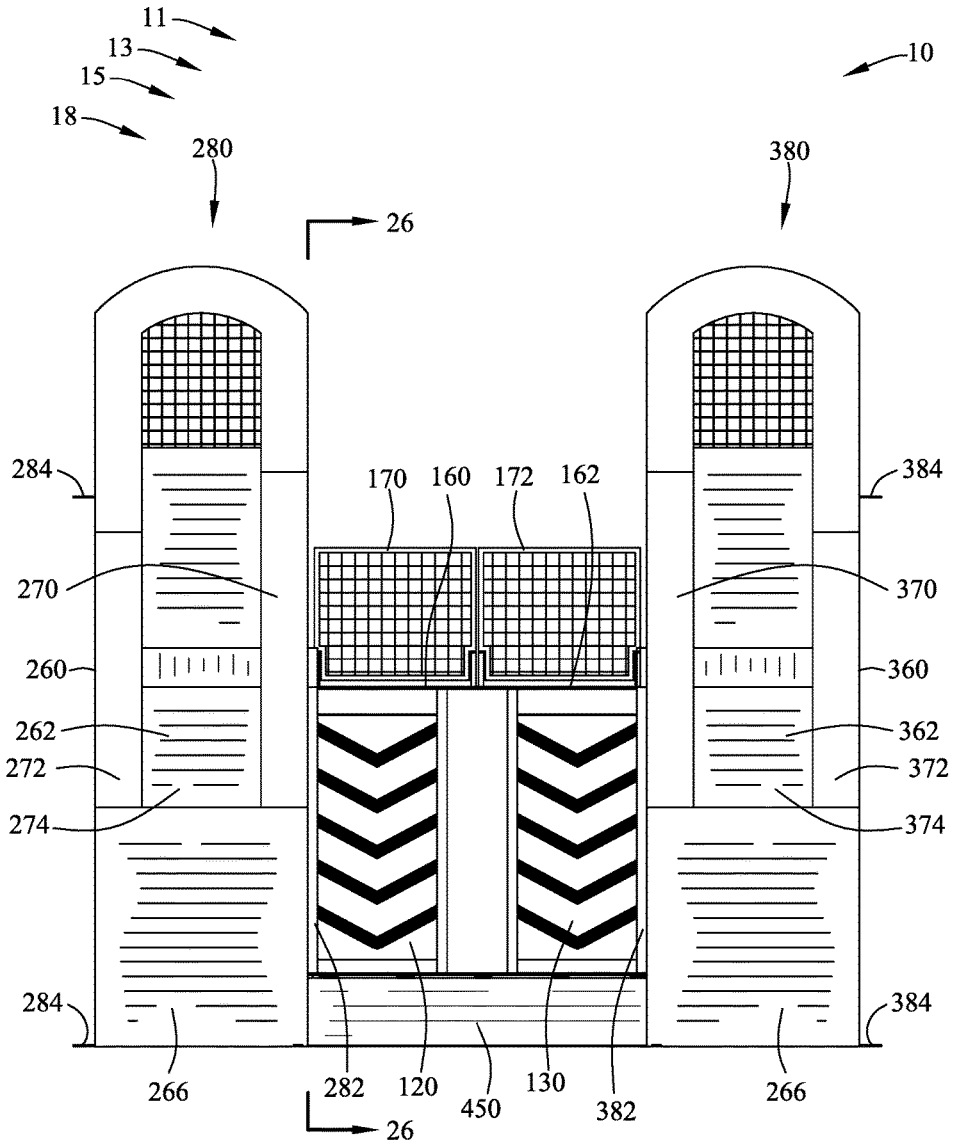
FIG. 25 is a rear view of FIG. 20.
Figure 26:
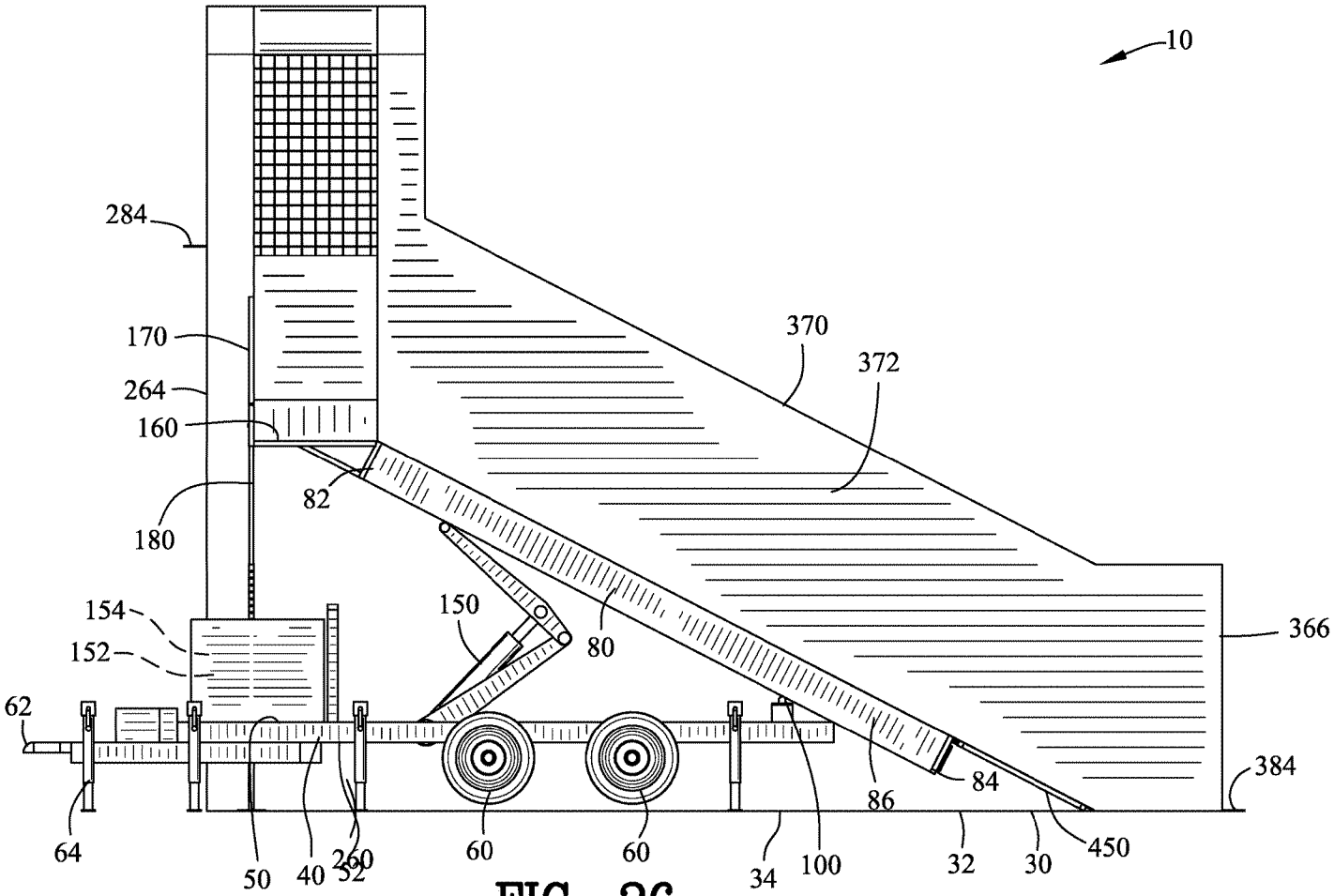
FIG. 26 is a sectional view along line 26-26 in FIG. 25.

FIGS. 1-31 illustrate an obstacle apparatus 10 for an individual 12 to traverse. Alternatively, the mobile obstacle apparatus 10 may be utilized by an animal 14 to traverse. The obstacle apparatus 10 may include a non-mobile apparatus 11 that is primarily utilized as a non-transportable amusement device 13. Alternatively, the obstacle apparatus 10 may include a mobile apparatus 15 that is primarily utilized as a transportable amusement device 18. The obstacle apparatus 10 may be utilized as an amusement device 20, an exercise device 22, an obstacle device 24, a competitive device 26, a relay device 28 or other applications. The obstacle apparatus 10 is supported by a surface 30. The surface 30 may include a ground surface 32, a roadway 34 or other supporting services.

The obstacle apparatus 10 comprises a chassis 40 extending between a proximal end 42, a distal end 44, a first side 46, a second side 48, an upper side 50 and a lower side 52. Preferably, the chassis 40 includes a trailer chassis 54. The trailer chassis 54 may include a first trailer axle 56 and a second trailer axle 58. A plurality of wheels 60 are rotatably coupled to the first trailer axle 56 and the second trailer axle 58 for coupling the plurality of wheels 60 to the chassis 40. The plurality of wheels 60 facilitate the transportation of the chassis 40 over the surface 30. Preferably, the chassis 40 includes a trailer ball receiver 62 for engaging a trailer ball coupled to a vehicle. The vehicle is utilized for transporting the mobile obstacle apparatus 15 to different locations. A plurality of chassis telescoping jacks 64 may be coupled to the chassis 40 for stabilizing the chassis 40 while utilizing the mobile obstacle apparatus 10.

A frame 80 extends between a proximal end 82, a distal end 84, a first side 86, a second side 88, an upper side 90 and a lower side 92. A hinge 100 pivotably couples the chassis 40 and the frame 80 for positioning the frame 80 in an inclined orientation 102 relative to the chassis 40.

A first drum 110 is rotatably coupled to the frame 80. A second drum 112 is rotatably coupled to the frame 80. A belt 120 encircles the first drum 110 and the second drum 112 for defining a continuous loop belt system 122. A drive 124 engages the continuous loop belt system 122 for creating a displacement in the belt 120. The belt 120 defines an upper belt surface 126 for the individual 12 to traverse. Preferably, the drive 124 includes a drum motor 128 that is mounted within the first drum 110.

Figure 27:
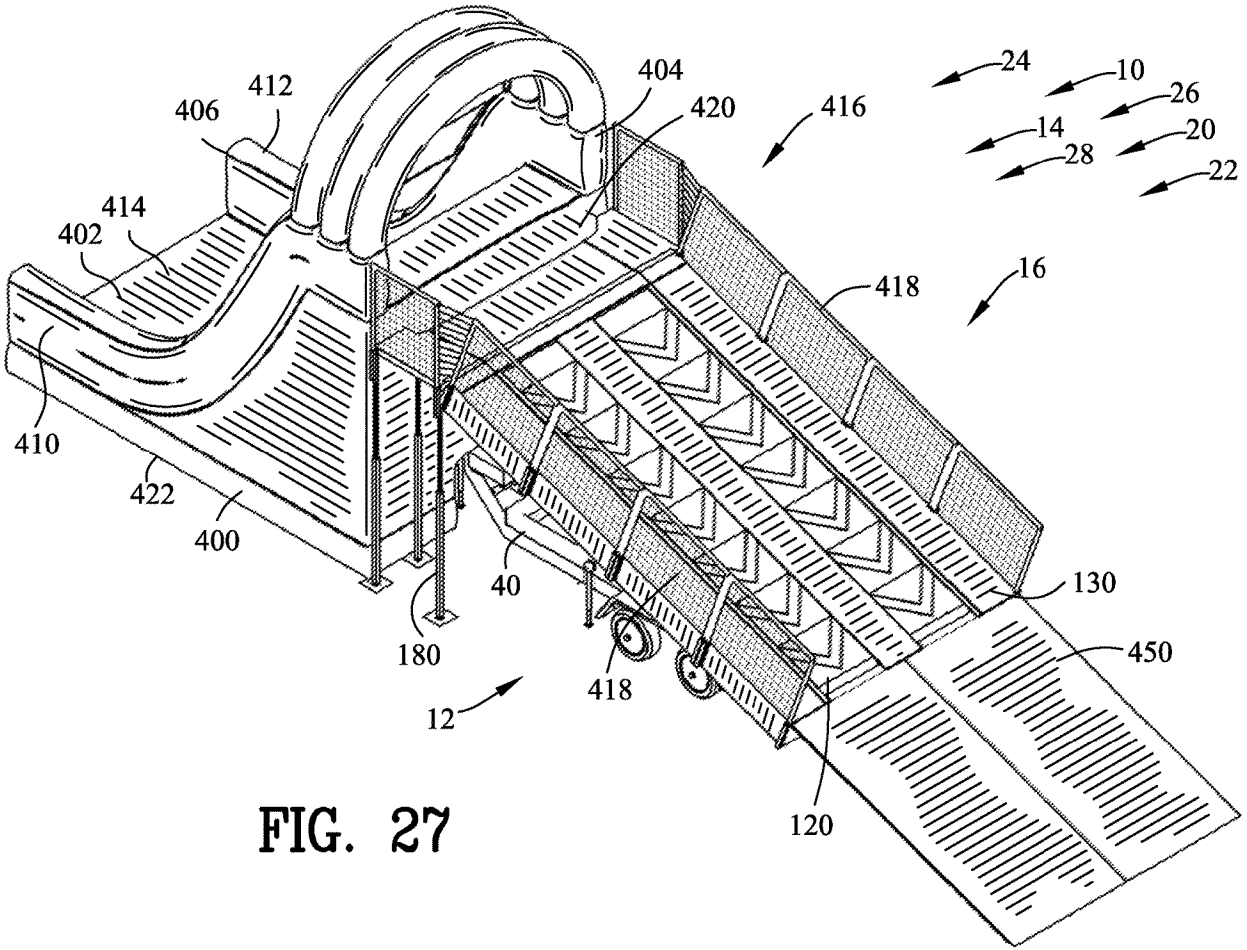
FIG. 27 is an upper rear view of a third embodiment of the mobile obstacle apparatus of the present invention.
Figure 28:
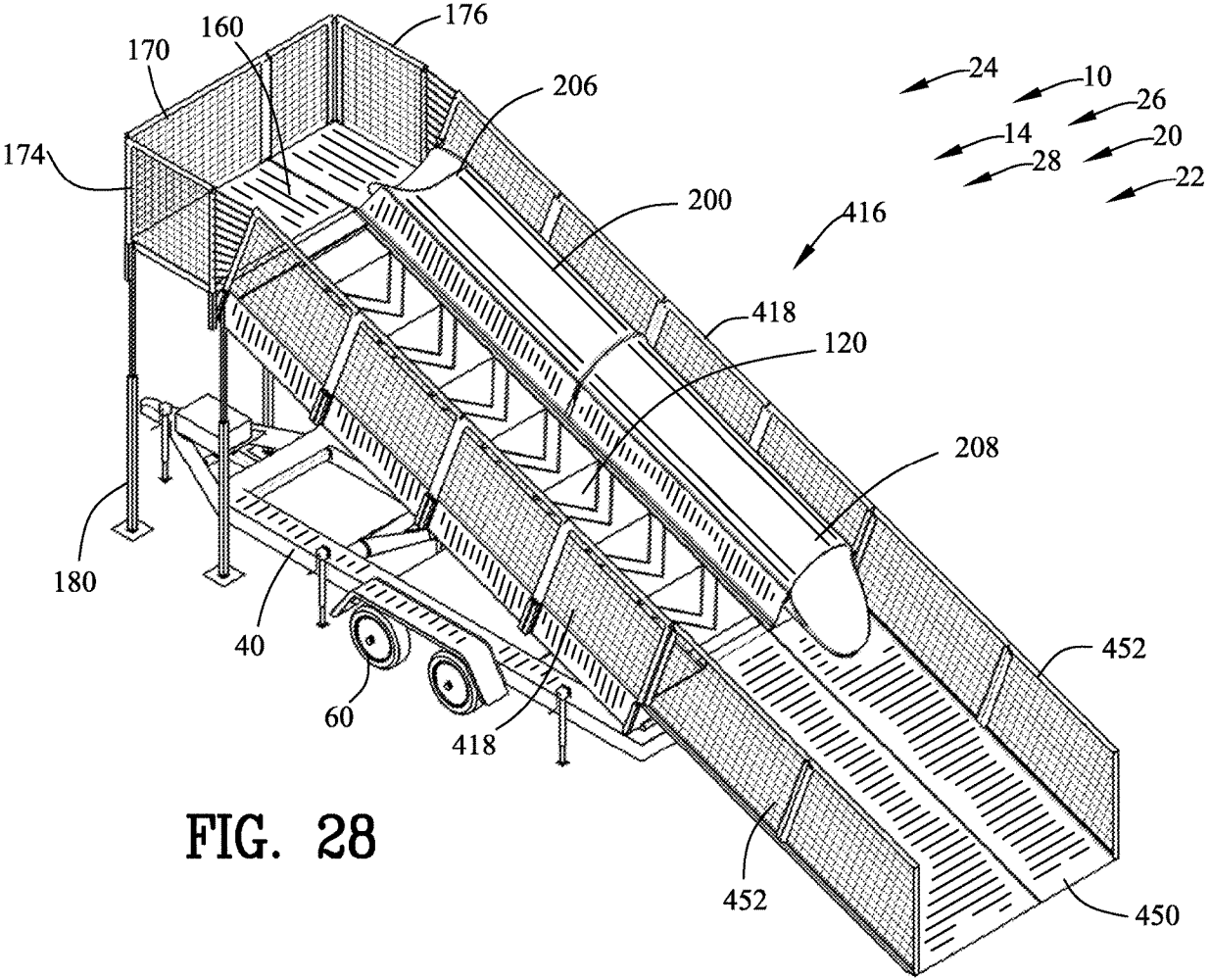
FIG. 28 is an upper rear view of a fourth embodiment of the mobile obstacle apparatus of the present invention.
Figure 29:
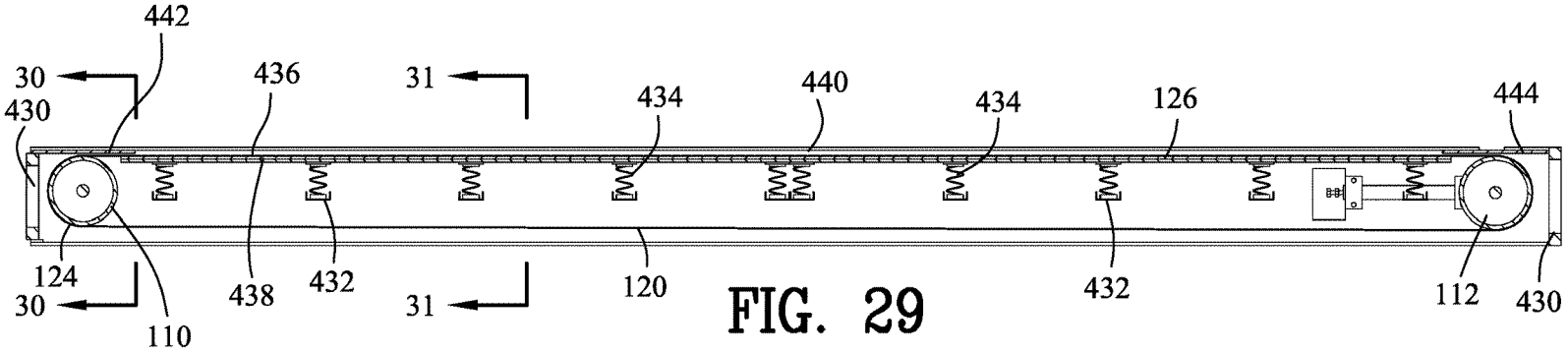
FIG. 29 is an enlarged portion of FIG. 7 illustrating a continuous loop belt system.
Figure 31:
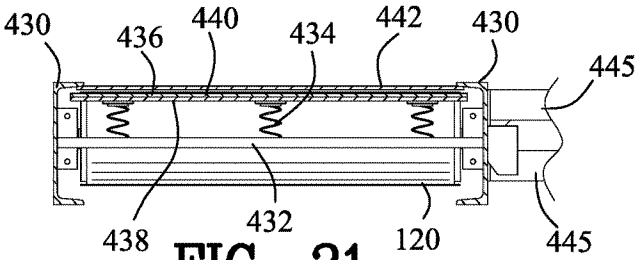
FIG. 31 is a sectional view along line 31-31 in FIG. 29.
Figure 30:
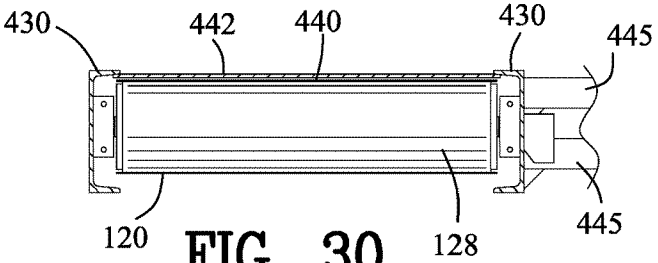
FIG. 30 is a sectional view along line 30-30 in FIG. 29.

FIG. 28 illustrates the obstacle apparatus 10 including a single continuous loop belt system 122. Alternatively, FIGS. 1-27 illustrate the obstacle apparatus 10 including a third drum 114 rotatably coupled to the frame 80. A fourth drum 116 rotatably coupled to the frame 80. A second belt 130 encircling the third drum 114 and the fourth drum 116 for defining a second continuous loop belt system 132. A second drive 134 engages the second continuous loop belt 132 system for creating a displacement in the second belt 130. The second belt 130 defines a second upper belt surface 136 for a second individual 16 to traverse. Preferably, the second drive includes a second drum motor 138 that is mounted within the third drum 114.

The displacement in the belt 120 defines a descending rotation 129 for increasing the difficulty for the individual 12 to traverse the upper belt surface 126. Similarly, the displacement in the second belt 130 defines a second descending rotation 139 for increasing the difficulty for the second individual 16 to traverse the second upper belt surface 136.

The descending rotation 129 and the second descending rotation 139 may be equivalent rotational speeds or maybe non-equivalent rotational speeds. Furthermore, the descending rotation 129 and the second descending rotation 139 may be independently altered by a control device 140 or a wireless device 142. As the descending rotation 126 and second descending rotation 139 is increased the difficulty to traverse the mobile obstacle apparatus 10 increases. As the descending rotation 126 and the second descending rotation 139 is decreased the difficulty to traverse the mobile obstacle apparatus decreases.

A hydraulic cylinder 150 is coupled between the chassis 40 and the frame 80 for pivoting the frame 80 relative to the chassis 40 about the hinge 100. A hydraulic pump 152 may be coupled to the chassis 40 for providing pressurized hydraulic fluid to the hydraulic cylinder 150. In addition, an electric generator 154 maybe coupled to the chassis 40 for providing an electric current to the drive 124 and the second drive 134. The angular displacement between the chassis 40 and the frame 80 may be increased in order to increase the difficulty for the first individual 12 and the second individual 16 to traverse the upper belt surface 126 and the second upper belt surface 136 respectively. The angular displacement between the chassis 40 and the frame 80 may be decreased in order to decrease the difficulty for the first individual 12 and the second individual 16 to traverse the upper belt surface 126 and the second upper belt surface 136 respectively. Furthermore, the angular displacement between the chassis 40 and the frame 80 may be altered by the control device 140 or the wireless device 142.

A platform 160 is coupled to the proximal end 82 of the frame 80 for supporting the individual 12 and the second individual 16 after traversing the upper belt surface 126 and the second upper belt surface 136. The platform 160 may include a main platform 162, a primary platform 164 and a secondary platform 166. A platform hinge 168 may pivotably couple the primary platform 164 with the main platform 162. Similarly, a platform hinge 168 may pivotably coupled the secondary platform 166 with the main platform 162.

As best shown in FIGS. 1-12, preferably the primary platform 164 and the secondary platform 166 are positioned in a vertical orientation for transporting the mobile obstacle apparatus 10. During the function of the mobile obstacle apparatus 10 the primary platform 164 and the secondary platform 166 are positioned into a horizontal orientation.

A railing 170 is coupled to the platform 160 for preventing individual 12 and or second individual 16 from falling from the platform 160. More specifically, the railing 170 may include a main railing 172, a primary railing 174 and a secondary railing 176. The main railing 172 may be removably engaged with the main platform 162. The primary railing 174 is preferably removably coupled with the primary platform 164. The secondary railing 176 is preferably removably coupled to the secondary platform 166. The railing 170 maybe additionally supported by a plurality of platform telescoping jacks 180.

A slide 200 may be coupled to the frame 80 for positioning the individual 12 from the platform 160 to the surface 30. As shown in FIGS. 1-16 and FIG. 28 the slide 200 may include a tubular member 202. The tubular member 202 defines an interior rigid sliding surface 204 extending between a proximal end 206 and a distal end 208. The proximal end 206 defines an upper entrance aperture 210 and may further include an upper entrance lip 212 for assisting the individual 12 in entering the tubular member 202. Furthermore, the distal end 208 includes a lower exit aperture 214 and may further include a lower exit lip 216 for assisting the individual 12 in exiting the tubular member 202.

The tubular member 202 is preferably coupled to the frame 80 by a pivot 220. The pivot 220 positions the tubular member 202 between a generally vertical orientation 222 relative to the upper belt surface 126 and a generally horizontal orientation 224 relative to the upper belt surface 126. The tubular member 202 would be positioned into the generally vertical orientation 222 during transportation of the mobile obstacle apparatus 10. Once the mobile obstacle apparatus 10 is positioned for operation, the tubular member 202 would be positioned into the generally horizontal orientation 224.

The tubular member 202 may be supported by a tubular member support frame 226. Preferably, the pivot 220 is secured between the frame 80 and the tubular member support frame 226. Slide telescoping jacks 228 may be fastened to the tubular member support frame 226 and engage the surface 34 supporting the tubular member 202.

A panel 230 may be coupled to the pivot 220. The panel 230 extends between a proximal end 232 and a distal end 234. The pivot 220 pivots the panel 230 between a generally horizontal orientation 236 during the tubular member 202 in the generally vertical orientation 222 and a generally vertical orientation 238 during the tubular member 202 in the generally horizontal orientation 224. The generally vertical orientation 238 of the panel 230 defines a retaining wall 240 for maintaining the individual 12 above the frame 80. The retaining wall 240 may include a cushion layer 242 to pad the individual 12 upon contact with the retaining wall 240. The cushion layer 242 may include a L-shaped cushion panel 244 wherein a first cushion layer is positioned in a horizontal position adjacent to the belt 120 and a second cushion layer is positioned in a vertical position adjacent to the retaining wall 240.

As shown in FIGS. 1-16 the obstacle apparatus 10 may include a second slide 300. The second slide 300 may include a second tubular member 302. The second tubular member 302 defines an interior rigid sliding surface 304 extending between a proximal end 306 and a distal end 308. The proximal end 306 defines a second upper entrance aperture 310 and may further include an upper entrance lip 312 for assisting the individual 12 in entering the second tubular member 302. Furthermore, the second distal end 308 includes a second lower exit aperture 314 and may further include a second lower exit lip 316 for assisting the individual 12 in exiting the second tubular member 302.

The second tubular member 302 is preferably coupled to the frame 80 by a second pivot 320. The second pivot 320 positions the second tubular member 302 between a second generally vertical orientation 322 relative to the second upper belt surface 136 and a second generally horizontal orientation 324 relative to the second upper belt surface 136. The second tubular member 302 would be positioned into the second generally vertical orientation 322 during transportation of the mobile obstacle apparatus 10. Once the mobile obstacle apparatus 10 is positioned for operation, the second tubular member 302 would be positioned into the second generally horizontal orientation 324.

The second tubular member 302 may be supported by a second tubular member support frame 326. Preferably, the second pivot 320 is secured between the frame 80 and the second tubular member support frame 326. Second slide telescoping jacks 328 may be fastened to the second tubular member support frame 326 and engage the surface 34 supporting the second tubular member 302.

A second panel 330 may be coupled to the second pivot 320. The second panel 330 extends between a second proximal end 332 and a second distal end 334. The second pivot 320 pivots the second panel 330 between a second generally horizontal orientation 336 during the second tubular member 302 in the second generally vertical orientation 322 and a second generally vertical orientation 338 during the second tubular member 302 in the second generally horizontal orientation 324. The second generally vertical orientation 338 of the second panel 330 defines a second retaining wall 340 for maintaining the second individual 16 above the frame 80. The second retaining wall 340 may include a second cushion layer 342 to pad the second individual 16 upon contact with the second retaining wall 340. The second cushion layer 342 may include a L-shaped cushion panel 344 wherein a first cushion layer is positioned in a horizontal position adjacent to the second belt 130 and a second cushion layer is positioned in a vertical position adjacent to the second retaining wall 340.

As shown in FIGS. 17-26, the slide 200 may include an inflatable bladder 260 defining an exterior semi-rigid sliding surface 262 extending between a proximal end 264 and a distal end 266. The inflatable bladder 260 includes an inflatable retaining wall 270 adjacent to the frame 80 for maintaining the individual 12 above the frame 80. In addition, the inflatable bladder 260 may include an inflatable exterior wall 272. The inflatable retaining wall 270 and the inflatable exterior wall 272 define an inflatable slide channel 274 for maintaining the individual 12 above the semi rigid sliding surface 262. The inflatable bladder 260 may further include an upper 90° entrance 276 transitioning from the platform 160 into the semi-rigid sliding surface 262. In addition, the inflatable bladder 260 may include a lower 90° exit 278 transitioning from the semi rigid sliding surface 262 to the surface 30. The combination of the belt 120, the platform 160, the upper 90° entrance 276 and the semi-rigid sliding surface 262 defines a general U-shaped path 280. The general U-shaped path 280 provides a smaller surface area that is occupied by the mobile obstacle apparatus 10.

The inflatable bladder 260 may be coupled to the frame 80 by a plurality of frame couplers 282. The plurality of frame couples 282 may include fasteners, looking loop devices, islets and hooks or other fastening means. In addition, the inflatable bladder 260 may be secured to the surface 30 by a plurality of surface couplers 284. The plurality of surface couplers 284 may include ground stakes, ground anchors, weights or other restraining devices.

As shown in FIGS. 17-26, the second slide 300 may include a second inflatable bladder 360 defining a second exterior semi-rigid sliding surface 362 extending between a second proximal end 364 and a second distal end 366. The second inflatable bladder 360 includes a second inflatable retaining wall 370 adjacent to the frame 80 for maintaining the second individual 16 above the frame 80. In addition, the second inflatable bladder 360 may include a second inflatable exterior wall 372. The second inflatable retaining wall 370 and the second inflatable exterior wall 372 defines a second inflatable slide channel 374 for maintaining the second individual 16 above the second semi rigid sliding surface 362. The second inflatable bladder 360 may further include a second upper 90° entrance 376 transitioning from the platform 160 into the second semi-rigid sliding surface 362. In addition, the second inflatable bladder 360 may include a second lower 90° exit 378 transitioning from the second semi rigid sliding surface 362 to the surface 30. The combination of the second belt 130, the platform 160, the second upper 90° entrance 376 and the second semi-rigid sliding surface 362 defines a second general U-shaped path 380. The second general U-shaped path 380 provides a smaller surface area that is occupied by the mobile obstacle apparatus 10.

The second inflatable bladder 360 may be coupled to the frame 80 by a second plurality of frame couplers 382. The second plurality of frame couples 382 may include fasteners, hook and loop devices, islets and hooks or other fastening means. In addition, the second inflatable bladder 360 may be secured to the surface 30 by a second plurality of surface couplers 384. The second plurality of surface couplers 384 may include ground stakes, ground anchors, weights or other restraining devices.

FIG. 27 illustrates the obstacle apparatus 10 including an inflatable bladder 400. The inflatable bladder 400 includes a semi-rigid sliding surface 402 extending between a proximal end 404 and a distal end 406. The inflatable bladder 400 includes a primary inflatable external retaining wall 410 and a second inflatable exterior retaining wall 412 for defining an inflatable slide channel 414. The belt 120 and the second belt 130 in combination with the platform 160 and the inflatable bladder 400 define a linear path 416. Preferably, the frame 80 includes a frame railing 418 for maintaining the individual 12 and the second individual 16 above the frame 80.

The inflatable bladder 400 is coupled to the platform 160 by a plurality of platform couplers 420. The plurality of platform couplers 420 may include fasteners, hook and loop devices, islets in hooks or other fastening devices. In addition, the inflatable bladder 400 may be secured to the surface 30 by a plurality of surface couplers 422. The plurality of surface couplers 422 may include ground stakes, ground anchors, weights or other restraining devices.

FIGS. 7 and 29-31 illustrate a possible construction of the continuous loop belt system 122 and the second continuous the belt system 132. More specifically, the continuous loop belt system 122 and the second continuous belt system 132 may include a peripheral main frame C-channel 430. A plurality of interior C-channels 432 may extend within the peripheral main frame C-channel 430.

A plurality of springs 434 are positioned within the plurality of interior C-channels 432 and extend towards the upper belt surface 126 and the second upper belt surface 136. A lower supporting panel 436 is secured to the plurality of springs 434. The lower supporting panel 436 may include wood, metal or other rigid materials. An upper supporting panel 438 of butts the lower supporting panel 436. The lower supporting panel 436 and the upper supporting panel 438 may be secured together by adhesives, screws or other coupling means. The upper supporting panel 438 may include a polymeric material for avoiding damaging the belt 120 and the second belt 130. The plurality of springs 434 permit displacement and cushioning of the belt 120 and the second belt 130 upon the individual 12 or the second individual 16 falling into the belt 120 and the second belt 130 respectively. By permitting displacement and cushioning of the first belt 120 and the second belt 130 the risk of injury is reduced.

The frame 80 further includes a lower belt plate 442 for covering the second drum 112 and the fourth drum 116. In addition, an upper belt plate 444 covers the first drum 110 and the third drum 114. The lower belt plate 442 and the upper belt plate 444 prevents the individual 12 and the second individual 16 from being waged between the belt 120 and the second belt 130 to the frame 80 respectively.

Preferably, the peripheral main frame C-channel 430 of the continuous loop belt system 122 and the peripheral main frame C-channel 430 of the second continuous loop belt system 132 are coupled by a plurality of coupling C-channels 445.

The obstacle apparatus 10 may further include a tailgate 450 that is pivotably coupled to the frame 80. The tailgate 450 provides a gradual transition from the surface 30 to the continuous loop belt system 122 and the second continuous loop belt system 132. In addition, the tailgate 150 may include a tailgate railing 450.

The present invention further includes the method for providing an obstacle for an individual 12 to traverse. The method comprises the steps of rotating a belt 120 encircling a first drum 110 and a second drum 112 coupled to a frame 80 in a descending direction for the individual 12 to traverse between a first elevation 70 to a second elevation 72. The individual 12 is supported upon a platform 160 after traversing the belt 120 in the second elevation 72. The individual 12 descends upon a slide 200 for positioning the individual 12 from the second elevation 72 to the first elevation 70. The method may further include the steps of rotating a second belt 130 encircling a third drum 114 and a four drum 116 coupled to a frame 80 in a descending direction for a second individual 16 to traverse between the first elevation 70 to the second elevation 72. The second individual 16 is supported upon the platform 160 after traversing the second belt 130 in the second elevation 72. The second individual 16 descends upon a second slide 300 for positioning the second individual 16 from the second elevation 72 to the first elevation 70.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A mobile obstacle apparatus for an individual to traverse, the mobile obstacle apparatus supported by a surface, the mobile obstacle apparatus, comprising:

a chassis extending between a proximal end, a distal end, a first side, a second side, an upper side and a lower side;

a plurality of wheels rotatably coupled to said chassis for transporting said chassis over the surface;

a frame extending between a proximal end, a distal end, a first side, a second side, an upper side and a lower side;

a hinge pivotably coupling said chassis and said frame for positioning said frame in an inclined orientation relative to said chassis;

a first drum rotatably coupled to said frame;

a second drum rotatably coupled to said frame;

a belt encircling said first drum and said second drum for defining a continuous loop belt system;

a drive engaging said continuous loop belt system for creating a displacement in said belt;

said belt defining an upper belt surface for the individual to traverse;

a slide coupled to said frame for positioning the individual to the surface;

and said slide including an interior sliding surface extending between a proximal end and a distal end of said slide.

2. A mobile obstacle apparatus for the individual to traverse as set forth in claim 1, wherein said displacement in said belt defining a descending rotation for increasing the difficulty for the individual to traverse said upper belt surface.

3. A mobile obstacle apparatus for the individual to traverse as set forth in claim 1, further including a platform coupled to said proximal end of said frame for supporting individual after traversing said upper belt surface.

4. A mobile obstacle apparatus for the individual to traverse as set forth in claim 3, further including a railing coupled to said platform for preventing individual from falling from said platform.

5. A mobile obstacle apparatus for the individual to traverse as set forth in claim 3, wherein said slide coupled to said platform for positioning the individual to the surface.

6. A mobile obstacle apparatus for the individual to traverse as set forth in claim 5, wherein said slide includes an inflatable bladder defining an exterior semi-rigid sliding surface extending between a proximal end and a distal end.

7. A mobile obstacle apparatus for the individual to traverse as set forth in claim 1, wherein said slide includes a tubular member defining an interior rigid sliding surface extending between a proximal end and a distal end.

8. A mobile obstacle apparatus for the individual to traverse as set forth in claim 7, further including a pivot for pivotably coupling said frame and said tubular member for positioning said tubular member between a generally vertical orientation relative to said upper belt surface and a generally horizontal orientation relative to said upper belt surface.

9. A mobile obstacle apparatus for the individual to traverse as set forth in claim 8, further including a panel coupled to said pivot for pivotably said panel between a generally horizontal orientation during said tubular member in said generally vertical orientation and a generally vertical orientation during said tubular member in said generally horizontal orientation; and said generally vertical orientation of said panel defining a retaining wall for maintaining the individual above said frame.

10. A mobile obstacle apparatus for the individual to traverse as set forth in claim 1, wherein said slide includes an inflatable bladder defining an exterior semi-rigid sliding surface extending between a proximal end and a distal end.

11. A mobile obstacle apparatus for the individual to traverse as set forth in claim 10, wherein said inflatable bladder includes an inflatable retaining wall adjacent to said frame for maintaining the individual above said frame.

12. A mobile obstacle apparatus for the individual to traverse as set forth in claim 1, further including a trailer ball receiver coupled to said proximal end of said chassis.

13. A mobile obstacle apparatus for the individual to traverse as set forth in claim 1, further including a plurality of telescoping jacks coupled to said chassis for stabilizing said chassis.

14. A mobile obstacle apparatus for the individual to traverse as set forth in claim 1, further including a hydraulic cylinder coupled between said chassis and said frame for pivoting said frame relative to said chassis about said hinge.

15. A mobile obstacle apparatus for the individual to traverse as set forth in claim 14, further including a hydraulic pump coupled to said chassis for providing pressurized hydraulic fluid to said hydraulic cylinder.

16. A mobile obstacle apparatus for the individual to traverse as set forth in claim 1, further including an electric generator coupled to said chassis for providing an electric current to said drive.

17. A mobile obstacle apparatus for the individual to traverse as set forth in claim 1, further including a third drum rotatably coupled to said frame;

a fourth drum rotatably coupled to said frame;

a second belt encircling said third drum and said fourth drum for defining a second continuous loop belt system;

a second drive engaging said second continuous loop belt system for creating a displacement in said second belt; and said second belt defining a second upper belt surface for the individual to traverse.

18. A mobile obstacle apparatus for the individual to traverse as set forth in claim 17, wherein said displacement in said second belt defining a second descending rotation for increasing the difficulty for the individual to traverse said second upper belt surface.

19. A mobile obstacle apparatus for the individual to traverse as set forth in claim 17, further including a platform coupled to said proximal end of said frame for supporting individual after traversing said second upper belt surface.

20. A mobile obstacle apparatus for the individual to traverse as set forth in claim 19, wherein said slide coupled to said platform for positioning the individual to the surface.

21. A mobile obstacle apparatus for the individual to traverse as set forth in claim 20, wherein said slide includes an inflatable bladder defining an exterior semi-rigid sliding surface extending between a proximal end and a distal end.

22. A mobile obstacle apparatus for the individual to traverse as set forth in claim 17, further including a railing coupled to said platform for preventing individual from falling from said platform.

23. A mobile obstacle apparatus for the individual to traverse as set forth in claim 17, further including a second slide coupled to said frame for positioning the individual to the surface.

24. A mobile obstacle apparatus for the individual to traverse as set forth in claim 23, wherein said second slide includes a second tubular member defining a second interior rigid sliding surface extending between a proximal end and a distal end.

25. A mobile obstacle apparatus for the individual to traverse as set forth in claim 24, further including a second pivot for pivotably coupling said frame and said second tubular member for positioning said second tubular member between a generally vertical orientation relative to said second upper belt surface and a generally horizontal orientation relative to said second upper belt surface.

26. A mobile obstacle apparatus for the individual to traverse as set forth in claim 25, further including a second panel coupled to said second pivot for pivotably said second panel between a generally horizontal orientation during said second tubular member in said generally vertical orientation and a generally vertical orientation during said second tubular member in said generally horizontal orientation; and said generally vertical orientation of said second panel defining a second retaining wall for maintaining the individual above said frame.

27. A mobile obstacle apparatus for the individual to traverse as set forth in claim 23, wherein said second slide includes a second inflatable bladder defining a second exterior semi-rigid sliding surface extending between a proximal end and a distal end.

28. A mobile obstacle apparatus for the individual to traverse as set forth in claim 27, wherein said second inflatable bladder includes a second inflatable retaining wall adjacent to said frame for maintaining the individual above said frame.

29. A method for providing an obstacle for an individual to traverse, the method comprising the steps of:

rotating a belt encircling a first drum and a second drum coupled to a frame in a descending direction for the individual to traverse between a first elevation to a second elevation;

supporting the individual upon a platform after traversing said belt in said second elevation; and descending the individual upon a slide for positioning the individual from said second elevation to said first elevation.

30. A method for providing an obstacle for an individual to traverse as set forth in claim 29, further including the steps of:

rotating a second belt encircling a third drum and a four drum coupled to a frame in a descending direction for a second individual to traverse between a first elevation to a second elevation;

supporting the second individual upon a platform after traversing said second belt in said second elevation; and descending the second individual upon a second slide for positioning the second individual from said second elevation to said first elevation.

31. An obstacle apparatus for an individual to traverse, the obstacle apparatus supported by a surface, the obstacle apparatus, comprising:

a chassis extending between a proximal end, a distal end, a first side, a second side, an upper side and a lower side;

a frame extending between a proximal end, a distal end, a first side, a second side, an upper side and a lower side;

a hinge pivotably coupling said chassis and said frame for positioning said frame in an inclined orientation relative to said chassis;

a first drum rotatably coupled to said frame;

a second drum rotatably coupled to said frame;

a belt encircling said first drum and said second drum for defining a continuous loop belt system;

a drive engaging said continuous loop belt system for creating a displacement in said belt;

said belt defining an upper belt surface for the individual to traverse;

said displacement in said belt defining a descending rotation for increasing the difficulty for the individual to traverse said upper belt surface;

a platform coupled to said proximal end of said frame for supporting individual after traversing said upper belt surface; and a slide coupled adjacent to said platform for positioning the individual to the surface.

32. A mobile obstacle apparatus for the individual to traverse as set forth in claim 31, further including a railing coupled to said platform for preventing individual from falling from said platform.

33. A mobile obstacle apparatus for the individual to traverse as set forth in claim 31, wherein said slide includes a tubular member defining an interior rigid sliding surface extending between a proximal end and a distal end.

34. A mobile obstacle apparatus for the individual to traverse as set forth in claim 33, further including a pivot for pivotably coupling said frame and said tubular member for positioning said tubular member between a generally vertical orientation relative to said upper belt surface and a generally horizontal orientation relative to said upper belt surface.

35. A mobile obstacle apparatus for the individual to traverse as set forth in claim 34, further including a panel coupled to said pivot for pivotably said panel between a generally horizontal orientation during said tubular member in said generally vertical orientation and a generally vertical orientation during said tubular member in said generally horizontal orientation; and said generally vertical orientation of said panel defining a retaining wall for maintaining the individual above said frame.

36. A mobile obstacle apparatus for the individual to traverse as set forth in claim 31, wherein said slide includes an inflatable bladder defining an exterior semi-rigid sliding surface extending between a proximal end and a distal end.

37. A mobile obstacle apparatus for the individual to traverse as set forth in claim 36, wherein said inflatable bladder includes an inflatable retaining wall adjacent to said frame for maintaining the individual above said frame.

38. An obstacle apparatus for an individual to traverse, the obstacle apparatus supported by a surface, the obstacle apparatus, comprising:

a chassis extending between a proximal end, a distal end, a first side, a second side, an upper side and a lower side;

a frame extending between a proximal end, a distal end, a first side, a second side, an upper side and a lower side;

a hinge pivotably coupling said distal end of said chassis and said distal end of said frame for elevating said proximal end of said frame and positioning said frame in an inclined orientation relative to said chassis;

a first drum rotatably coupled to said frame;

a second drum rotatably coupled to said frame;

a belt encircling said first drum and said second drum for defining a continuous loop belt system;

a drive engaging said continuous loop belt system for creating a displacement in said belt;

said belt defining an upper belt surface for the individual to traverse;

said displacement in said belt defining a descending rotation for increasing the difficulty for the individual to traverse said upper belt surface;

a platform coupled to said proximal end of said frame; and said platform having a support surface for supporting the individual after traversing said upper belt surface.

39. An obstacle apparatus for an individual to traverse, the obstacle apparatus supported by a surface, the obstacle apparatus, comprising:

a chassis extending between a proximal end, a distal end, a first side, a second side, an upper side and a lower side;

a frame extending between a proximal end, a distal end, a first side, a second side, an upper side and a lower side;

a coupling securing said chassis with said frame for elevating said proximal end of said frame and positioning said frame in an inclined orientation relative to said chassis;

a first drum rotatably coupled to said frame;

a second drum rotatably coupled to said frame;

a belt encircling said first drum and said second drum for defining a continuous loop belt system;

a drive engaging said continuous loop belt system for creating a displacement in said belt;

said belt defining an upper belt surface for the individual to traverse;

said displacement in said belt defining a descending rotation for increasing the difficulty for the individual to traverse said upper belt surface; and a platform coupled to said proximal end of said frame; and said platform having a support surface for supporting the individual after traversing said upper belt surface.

* * * * *